US010232997B2

(12) United States Patent
Engel et al.

(10) Patent No.: US 10,232,997 B2
(45) Date of Patent: Mar. 19, 2019

(54) FOOD CONTAINER SYSTEM

(71) Applicant: SNACKTOPS, INC., Carlsbad, CA (US)

(72) Inventors: Jeff Engel, Encinitas, CA (US); Allen Tucker, Vista, CA (US); Mike Henry, Carlsbad, CA (US)

(73) Assignee: SNACKTOPS, Inc., Carlsbad, CA (US)

( * ) Notice: Subject to any disclaimer, the term of this patent is extended or adjusted under 35 U.S.C. 154(b) by 0 days.

(21) Appl. No.: 15/706,755

(22) Filed: Sep. 17, 2017

(65) Prior Publication Data

US 2018/0079567 A1 Mar. 22, 2018

Related U.S. Application Data

(63) Continuation of application No. 15/700,155, filed on Sep. 10, 2017, now abandoned, and a continuation-in-part of application No. 29/580,613, filed on Oct. 11, 2016, now Pat. No. Des. 801,810, and a continuation-in-part of application No. 29/580,615, filed on Oct. 11, 2016, now Pat. No. Des. 803,051.

(60) Provisional application No. 62/406,049, filed on Oct. 10, 2016, provisional application No. 62/395,911, filed on Sep. 16, 2016.

(51) Int. Cl.

| | |
|---|---|
| ***B65D 51/28*** | (2006.01) |
| ***B65D 21/02*** | (2006.01) |
| *B65D 81/32* | (2006.01) |

(52) U.S. Cl.

CPC ..... *B65D 51/28* (2013.01); *B65D 21/0237* (2013.01); *B65D 81/3205* (2013.01)

(58) Field of Classification Search

CPC .... B65D 51/24–51/28; B65D 21/02–21/0237; B65D 81/32–81/3205; A47J 47/14

USPC ..... 220/254.1–254.9, 256.1–259.5

See application file for complete search history.

(56) References Cited

U.S. PATENT DOCUMENTS 7,111,748 B2 * 9/2006 Cha ..... A47G 19/065 220/4.27

8,870,010 B2 * 10/2014 Buck ..... A47G 19/2205 206/217

(Continued)

OTHER PUBLICATIONS

International Search Report and Written Opinion issued in PCT/US2017/051945 dated Jan. 8, 2018 (14 pages).

*Primary Examiner* — Kareen K Thomas

(74) *Attorney, Agent, or Firm* — Manuel de la Cerra

(57) ABSTRACT

A food container system is disclosed that includes a food container lid. The lid has a beverage container coupling structure that removably attaches to a beverage container. The beverage container coupling structure circumscribes a footprint of the lid. The lid also has a drink-hole surface within the lid footprint and an annular surface above the beverage container coupling structure and within the lid footprint. The annular surface is connected to the drink-hole planar surface and includes food container coupling structure that removably attaches to a second food container. A food compartment is formed from a food compartment inner wall extending from the annular surface, and a bottom connected to the food compartment inner wall. The lid also includes a drink hole extending through the drink-hole surface.

21 Claims, 38 Drawing Sheets

(56) References Cited

U.S. PATENT DOCUMENTS

| | | | | |
|---|---|---|---|---|
| 8,939,312 | B1 * | 1/2015 | Buck | A47G 19/065 220/212 |
| 9,038,845 | B1 | 5/2015 | Buck | |
| 9,327,881 | B1 | 5/2016 | Saranga | |
| 2003/0150857 | A1 * | 8/2003 | Tsai | B65D 21/0228 220/4.27 |
| 2013/0119065 | A1 * | 5/2013 | Buck | A47G 19/2205 220/523 |
| 2016/0128502 | A1 | 5/2016 | Buck | |
| 2017/0101236 | A1 * | 4/2017 | Buck | A47G 21/18 |

* cited by examiner

FOOD CONTAINER SYSTEM

RELATED APPLICATIONS

This application claims priority as a continuation to U.S. patent application Ser. No. 15/700,155 entitled "FOOD CONTAINER SYSTEM" filed on Sep. 10, 2017, as a continuation in part of U.S. patent application Ser. No. 29/580,613 entitled "BEVERAGE CONTAINER LID" filed on Oct. 11, 2016, and as a continuation in part of U.S. patent application Ser. No. 29/580,615 entitled "BEVERAGE CONTAINER LID" filed on Oct. 11, 2016, the contents of these applications are incorporated herein by reference.

This application is also related to U.S. Pat. No. 8,596,491 entitled "CUP LID WITH INTEGRATED CONTAINER" issued on Dec. 3, 2013; U.S. Pat. No. 8,695,845 entitled "TOP MOUNTING CAN CONTAINER" issued on Apr. 15, 2014; U.S. Pat. No. 8,381,935 entitled "CUP LID WITH INTEGRATED CONTAINER" issued on Feb. 26, 2013; U.S. Pat. No. 8,714,393 entitled "CUP LID WITH INTEGRATED CONTAINER" issued on May 6, 2014; U.S. Pat. No. 8,590,730 entitled "TOP MOUNTING CAN CONTAINER" issued on Nov. 26, 2013; U.S. Pat. No. 8,708,181 entitled "LID WITH INTEGRATED CONTAINER" issued on Apr. 29, 2014; U.S. Pat. No. 8,701,914 entitled "TWO-PART RECYCLABLE CUP" issued on Apr. 22, 2014; U.S. patent application Ser. No. 13/412,602 entitled "TOP MOUNTING BOTTLE CONTAINER" filed on Mar. 5, 2012; U.S. patent application Ser. No. 13/680,011 entitled "CUP LID WITH INTEGRATED CONTAINER" filed on Nov. 17, 2012; U.S. patent application Ser. No. 13/680,049 entitled "CUP LID WITH INTEGRATED CONTAINER" filed on Nov. 17, 2012; U.S. patent application Ser. No. 13/733,153 entitled "CUP LID WITH INTEGRATED CONTAINER" filed on Jan. 3, 2013; U.S. patent application Ser. No. 14/263,993 entitled "LID WITH INTEGRATED CONTAINER" filed on Apr. 28, 2014; U.S. patent application Ser. No. 14/269,016 entitled "A CONTAINER LID WITH ONE OR MORE CAVITIES" filed on May 2, 2014; U.S. patent application Ser. No. 14/274,576 entitled "A CONTAINER LID WITH A FOOD COMPARTMENT AND A SIP-HOLE" filed on May 9, 2014; U.S. patent application Ser. No. 14/313,907 entitled "A CONTAINER LID SYSTEM WITH A LID PORTION AND FOOD CONTAINER PORTION" filed on Jun. 24, 2014; and U.S. Patent Application Ser. 62/005,862 entitled "A CONTAINER LID SYSTEM WITH A LID PORTION AND FOOD CONTAINER PORTION" filed on May 30, 2014; U.S. patent application Ser. No. 29/500,266 entitled "BENDABLE DRINKING STRAW" filed on Aug. 22, 2014; U.S. Patent Application 62/038,209 entitled "BENDABLE SAFETY STRAW" filed on Aug. 16, 2014; U.S. Patent Application 62/105,256 entitled "BENDABLE SAFETY STRAW AND LIDS WITH FOOD COMPARTMENT" filed on Jan. 20, 2015; U.S. Patent Application 62/239,483 entitled "FOOD CONTAINER WITH PEEL OFF COVER" filed on Oct. 9, 2015, U.S. patent application Ser. No. 14/986,703 entitled "CUP LID WITH INTEGRATED CONTAINER" filed on Jan. 3, 2016; U.S. patent application Ser. No. 15/287,697 entitled "FOOD CONTAINER WITH SEAL-ON COVER" filed on Oct. 6, 2016; U.S. patent application Ser. No. 15/287,700 entitled "PORTABLE PACKAGING SYSTEM" filed on Oct. 6, 2016; and U.S. patent application Ser. No. 15/401,028 entitled "MOUNTABLE FOOD CONTAINER" filed on Jan. 7, 2017, all of which are assigned to the same entity as the present application. Each of these applications is incorporated herein by reference.

TECHNICAL FIELD

The present invention relates to food containers.

BACKGROUND OF THE INVENTION

The increased popularity of fast-food establishments, coupled with the popularity of consumption of food and beverages on the go, have led to the need for more convenient takeout packaging.

Billions of disposable beverage cups are used every year. Often those cups are part of a larger meal, and current technology dictates placing a lid on the beverage cup, and packing the food in a separate and detached container. This may be satisfactory for a consumer seated at a table. However, when the consumer must eat on the go, use of the current technology is problematic. Consider, for example, a consumer who is drinking a beverage and would like to access a breakfast sandwich in a takeout bag. The consumer must set aside the beverage, and then use one hand to hold the bag and the other hand to access the sandwich, then set aside the bag and use both hands to open the sandwich packaging. As shown in this example, current technology does not allow for convenient on-the-go consumption. Standard cup lids are simple covers that do not include an integrated container. Rather, known lids cover the contents of a cup which forms a closed container in combination with the cup itself To address some of these problems, yogurt manufacturers have placed a small food container on the lid of a yogurt cup. The food container (often holding nuts or granola) must be removed from the yogurt cup and then flipped over and opened, then the contents are poured into the yogurt cup. It is therefore not possible to simultaneously access the contents of the yogurt cup and the contents of the food container; rather, the food container must be completely disengaged from the cup to access either the contents of the yogurt cup or the contents of the food container. The food container that attaches to the yogurt cup in an upside-down position has a limited food-volume capacity because its walls taper as they proceed upward toward the bottom of the upside-down container. Without this tapering, the yogurt cup/food container complex would become top-heavy and cumbersome.

Other known devices having a container or shelf combined with a lid have limitations which makes these devices impractical to use. One category of devices includes a container combined with a cup, but utilizes a hole in the middle of the lid. This makes it impossible to store relatively circular items, i.e., non-ring or non-annular items having no central hole, in the container, such as hamburgers, cookies or muffins, for example. Another category of devices includes a container combined with a lid, but does not allow for simultaneous access to the contents of the cup and the container, nor for the container to be resealed or a drop-in container to be removed from the container. Other devices that include drop-in functionality require removal of the container before accessing the contents of the cup. Other devices have relatively small peel containers for pills such as mints and are not suitable for larger food items.

Thus simultaneous or intermittent access to the contents of known cups and the contents of an attached container is not possible. This makes for difficult consumption of coffee, soda, snacks, popcorn, etc., in malls, fast food restaurants, theaters, amusement parks, sports stadiums or in any other venue. For example, this makes it difficult to eat and drink food in a theater or stadium with one cup-holder per seat.

For at least the limitations described above, there is a need for a cup lid with integrated container that works within a food container system.

SUMMARY OF THE INVENTION

The present invention provides an elegant solution to the needs described above and provides numerous additional benefits and advantages as will be apparent to persons of skill in the art. A food container system is disclosed and claimed that includes a food container lid. The lid has a beverage container coupling structure that removably attaches to a beverage container. The beverage container coupling structure circumscribes a footprint of the lid. The lid also has a drink-hole surface within the lid footprint and an annular surface above the beverage container coupling structure and within the lid footprint. The annular surface is connected to the drink-hole planar surface and includes food container coupling structure that removably attaches to a second food container. A food compartment is formed from a food compartment inner wall extending from the annular surface, and a bottom connected to the food compartment inner wall. The lid also includes a drink hole extending through the drink-hole surface.

The annular surface may include a rim and an annular surface outer wall extending from the rim to a position lower than the rim and the annular surface outer wall outer wall contains the food container coupling structure. The annular surface may be concentric or non-concentric with the lid footprint.

The food container system may also include a cup adapted to nest in the food container, the cup may have a cover. The cup may also have a cup coupling structure, while the container inner wall may have a complementary cup coupling structure that detachably mates with the cup coupling structure, thereby securing the cup in the food container.

The food container system may also have a second food container that includes a bottom with a complementary food container coupling structure that detachably mates with the food container coupling structure, thereby securing the cup to the second food container to the food container lid. The complementary food container coupling structure may also have an inner wall with an inner wall coupling structure, and an outer wall with an outer wall coupling structure.

In a separate embodiment, the food container coupling structure may be located near the annular surface rim on the food compartment inner wall, much like the cup coupling structure. In this configuration, the complementary food container coupling structure outer wall coupling structure mates with the food container coupling structure.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. It will be understood that certain components and details may not appear in the figures to assist in more clearly describing the invention.

DETAILED DESCRIPTION

Figure 1A:
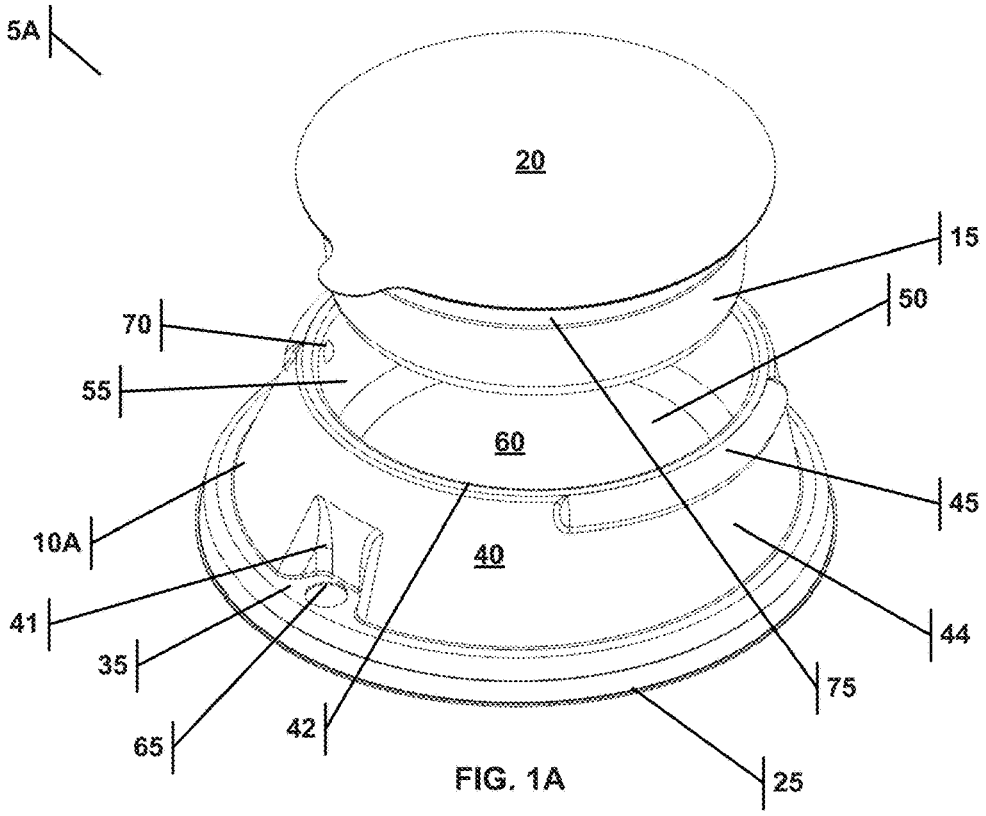
FIG. 1A illustrates a first embodiment of food container lid.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

The following list of example features corresponds with FIGS. 1A-10E and is provided for ease of reference, where like reference numerals designate corresponding features throughout the specification and figures:

Food container system (first embodiment) 5A
Food container system (second embodiment) 5B
Food container lid (first embodiment) 10A
Food container lid (second embodiment) 10B
Cup 15
Cover 20
Beverage container coupling structure 25
Lid footprint 30
Drink-hole surface 35
Annular surface 40
Inward jut 41
Annular surface rim 42
Annular surface outer wall 44
Food container coupling structure 45
Food compartment 50
Food compartment inner wall 55
Food compartment bottom 60
Drink/straw hole 65
Cup coupling structure 70
Complementary cup coupling structure 75
Beverage container 77
Second food container/tray (first embodiment) 80A
Second food container/tray (second embodiment) 80B
Second food container bottom 85
Complementary food container coupling structure 90
Complementary food container coupling structure inner wall 95
Complementary food container coupling structure inner wall coupling structure 100
Complementary food container coupling structure outer wall 105
Complementary food container coupling structure outer wall coupling structure 110
Second food container side walls 115
Strengthening ribs 120

Figure 1B:
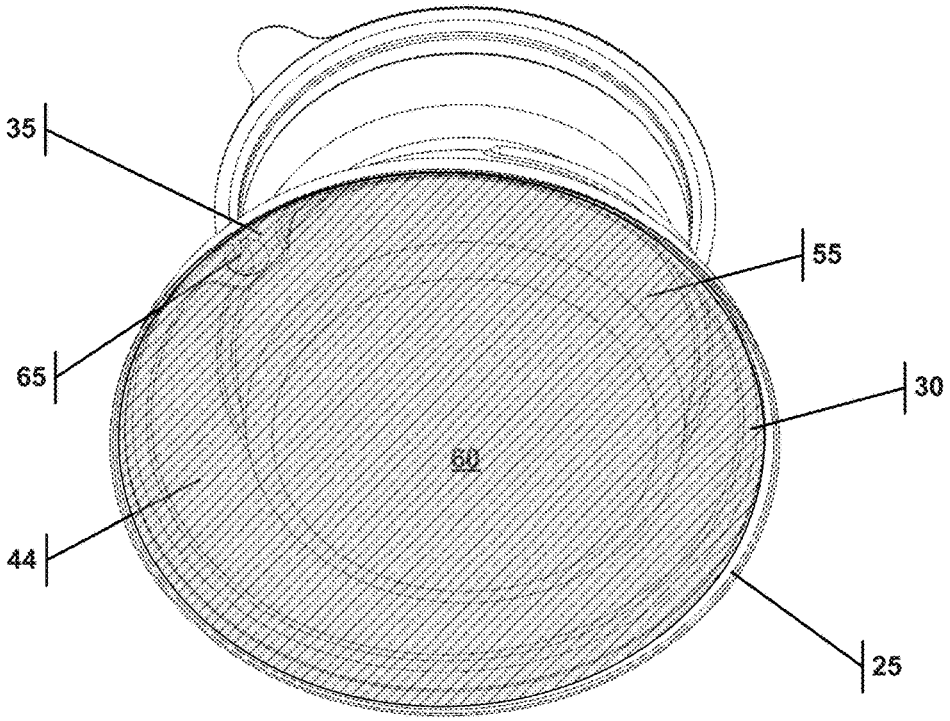
FIG. 1B illustrates the food container lid of FIG. 1A.

FIGS. 1A and 1B illustrate a food container system 5A that has a food container lid 10A and an optional cup 15. The lid 10A has a beverage container coupling structure 25 that removably attaches to a beverage container. The beverage container coupling structure 25 circumscribes a footprint of the lid 30 (shown in shaded crosshatch). The lid 10A also has a drink-hole surface 35 that is shown in a position above the beverage container coupling structure 25 and an annular surface 40 above the beverage container coupling structure 25 and within the lid footprint 30. The drink hole surface 35 is shown as planar, and the annular surface 40 has an inward jut 41 that allows more space for the drink-hole surface. The drink-hole surface 35 may be formed into and continuous with the annular surface 40.

The annular surface 40 may include a rim 42 and a container outer wall 44 extending from the rim 42 to a position lower than the rim 42. The food container coupling structure 45 may be part of the container outer wall 44.

A food compartment 50 is formed from a food compartment inner wall 55 extending from the annular surface rim 42 to a position lower than the annular surface rim 42, and a bottom 60 connected to the food compartment inner wall 55. The lid 10A also includes a drink hole 65 extending through the drink-hole surface.

The food container system may also include a cup 15 adapted to nest in the food compartment 50, the cup 15 may have a cover 20. The cup 15 may also have a complementary cup coupling structure 75, while the food compartment inner wall 55 may have a cup coupling structure 70 that detachably mates with the complementary cup coupling structure 75, thereby securing the cup 15 in the food compartment 50. While the cup 15 is shown to have the cover 20, the cover 20 may be applied directly to the annular surface rim 42, and the cup 15 need not be used. As non-limiting examples, the cover may be a seal-on/peel-off membrane, a hinged cover or a removable/reusable cover.

Figure 1D:
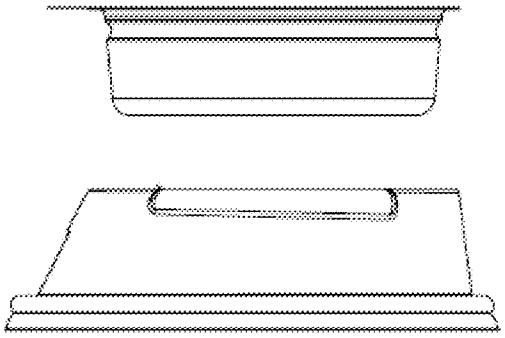
FIG. 1D is a side view showing the food container lid of FIG. 1A receiving the cup.
Figure 1F:
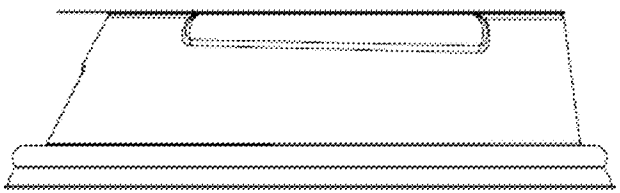
FIG. 1F is a side view showing the food container lid of FIG. 1A with the cup nested therein
Figure 1C:
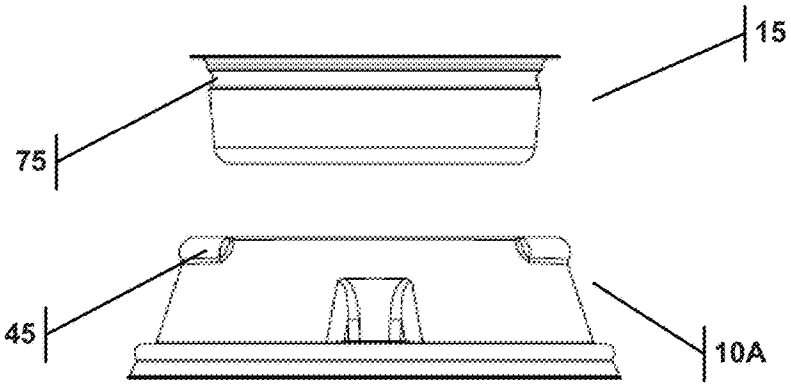
FIG. 1C is a front view showing the food container lid of FIG. 1A receiving a cup.
Figure 1E:
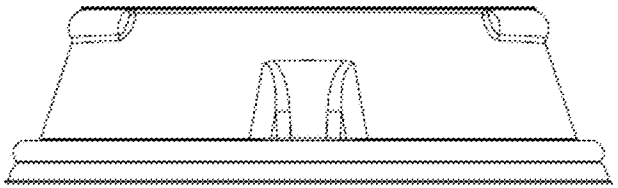
FIG. 1E is a front view showing the food container lid of FIG. 1A with the cup nested therein.
Figure 1G:
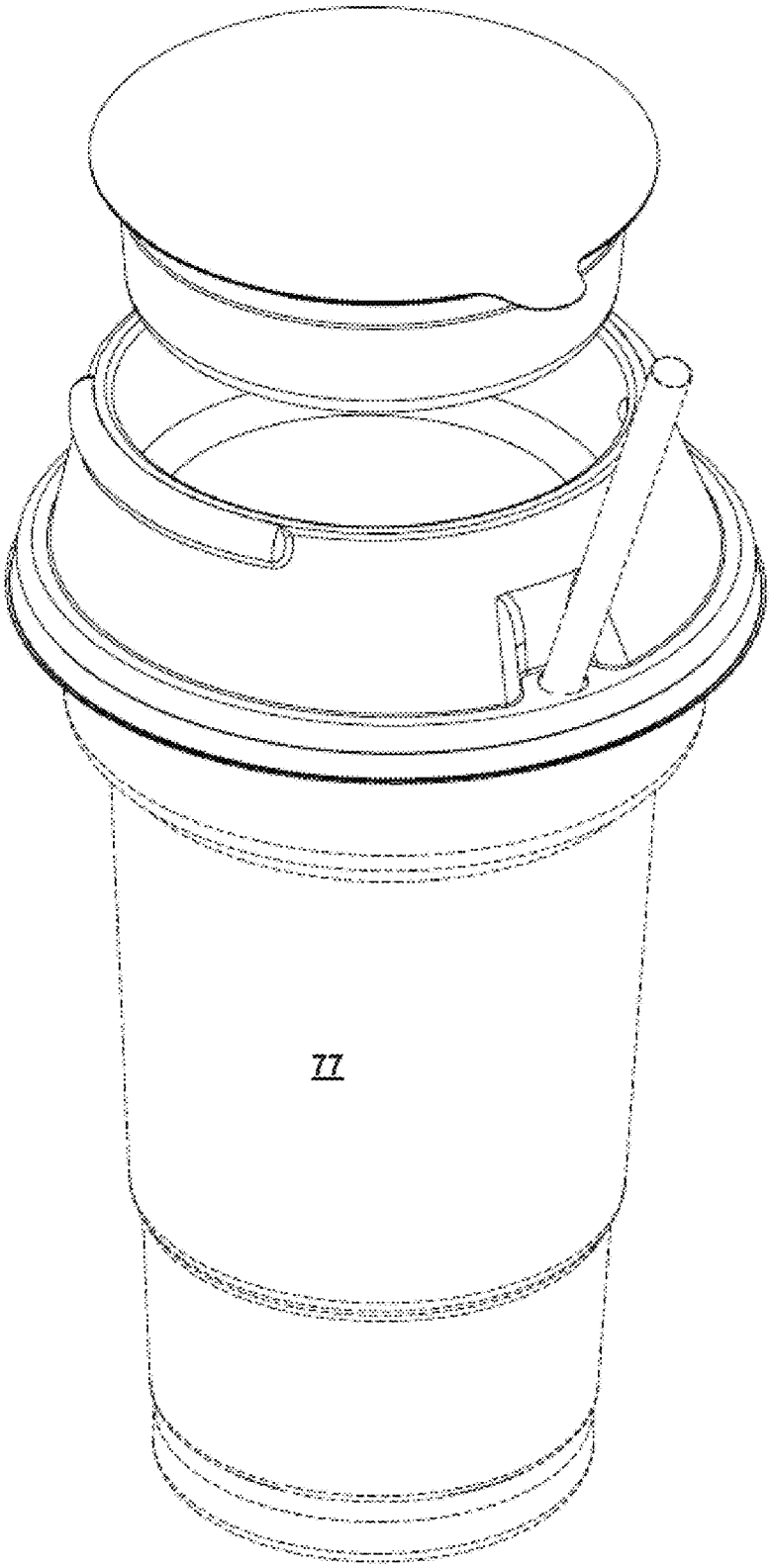
FIG. 1G is a perspective view showing the food container lid of FIG. 1A mounted to a beverage container receiving a food container cup.

FIG. 1C illustrates the complementary cup coupling structure 75 in greater detail. The cup coupling structure 70 disposed of on the inner wall 55 of the food compartment is a bump that fits into the groove of the complementary cup coupling structure 75, thus securing the cup 15 to the food container lid 10A. While the cup coupling structure 70 is illustrated as a bump, it can be a groove or a combination of a bump and groove and the complementary cup coupling structure 75 would have a shape that is complementary to make a secure fit. FIGS. 1D through 1F illustrate the nesting of the cup 15 in the food container lid 10A. Finally, the food container lid 10A may mount to a beverage container 77 via the beverage container coupling structure 25 as shown in FIG. 1G.

Figure 2A:
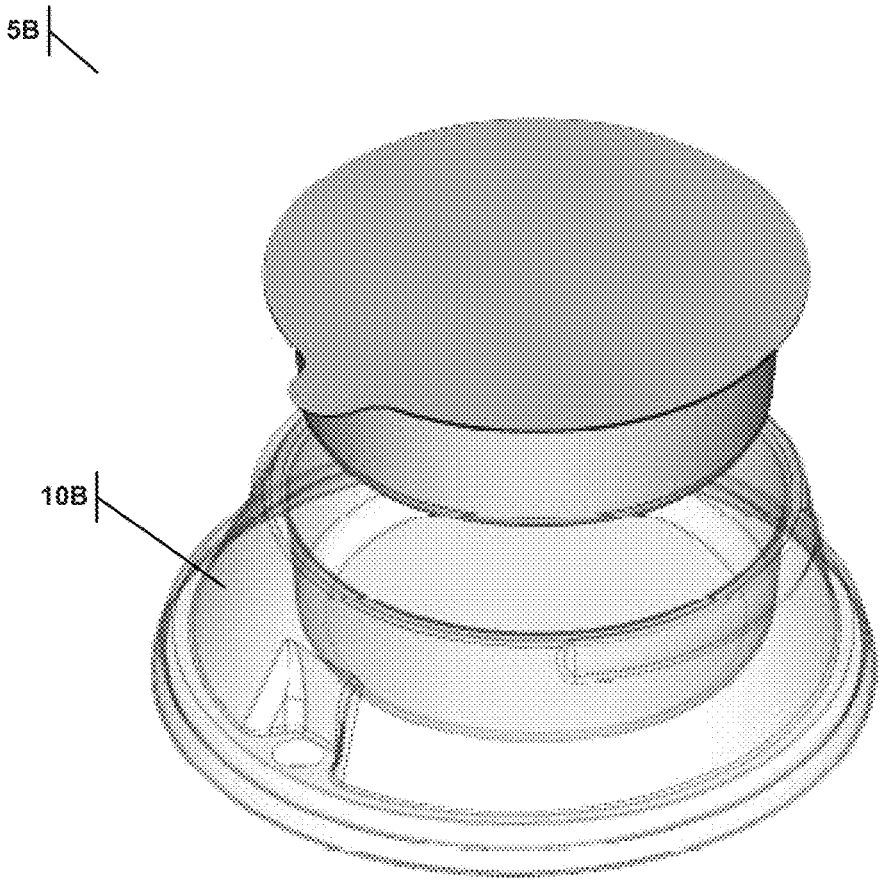
FIG. 2A illustrates a second embodiment of food container lid.
Figure 2B:
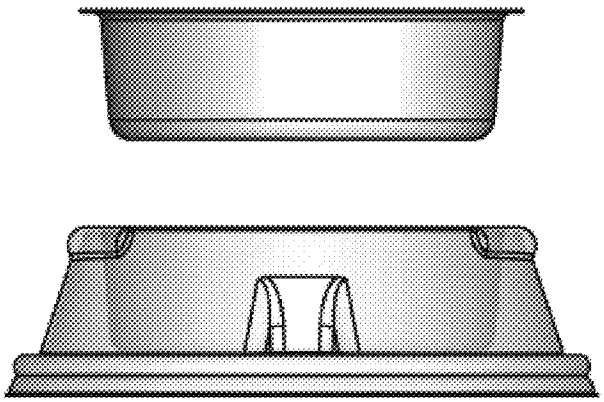
FIG. 2B is a front view showing the food container lid of FIG. 2A receiving a cup.
Figure 2C:
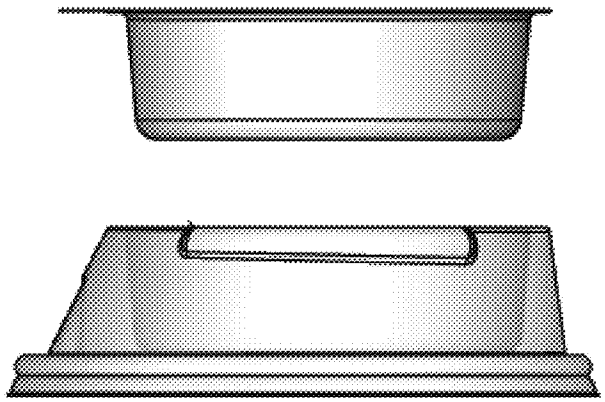
FIG. 2C is a side view showing the food container lid of FIG. 2A receiving the cup.
Figure 2D:
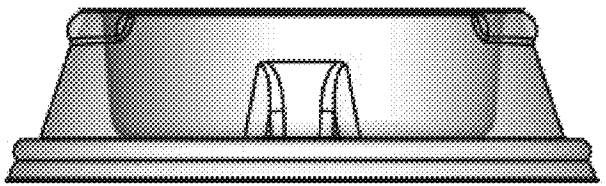
FIG. 2D is a front view showing the food container lid of FIG. 2A with the cup nested therein.
Figure 2E:
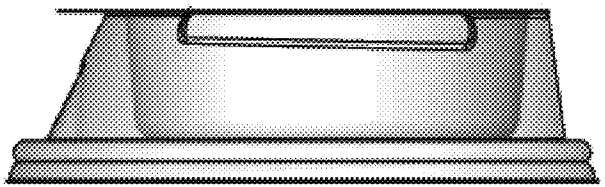
FIG. 2E is a side view showing the food container lid of FIG. 2A with the cup nested therein
Figure 2G:
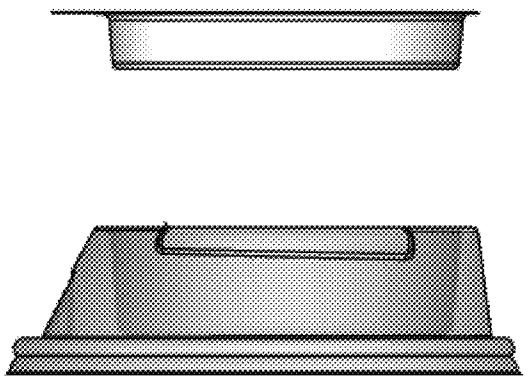
FIG. 2G is a side view showing the food container lid of FIG. 2A receiving the shallow cup.
Figure 2I:
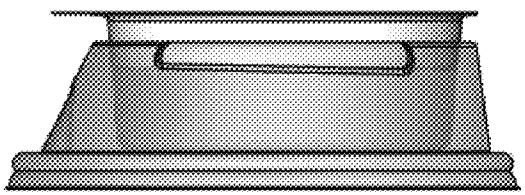
FIG. 2I is a side view showing the food container lid of FIG. 2A with the shallow food nested therein
Figure 2F:
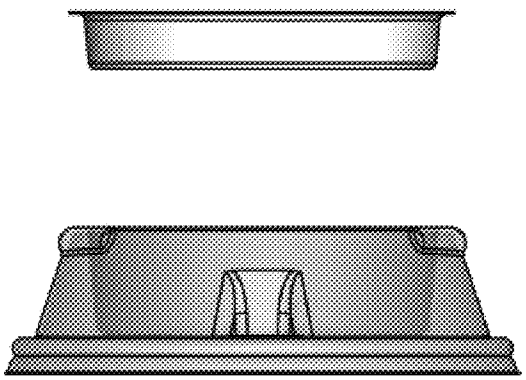
FIG. 2F is a front view showing the food container lid of FIG. 2A receiving a shallow cup.
Figure 2H:
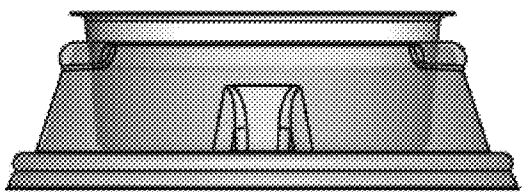
FIG. 2H is a front view showing the food container lid of FIG. 2A with the shallow cup nested therein.

FIGS. 2A though 2I illustrate a second embodiment of the food container system 5B with a lid 10B similar in many respects to the lid 10A just described. The difference is that the lid 10B shown in FIGS. 2A through 2I has a friction fit with the cup 15, thereby negating the cup coupling structure 70 and the complementary cup coupling structure 75.

Figure 3A:
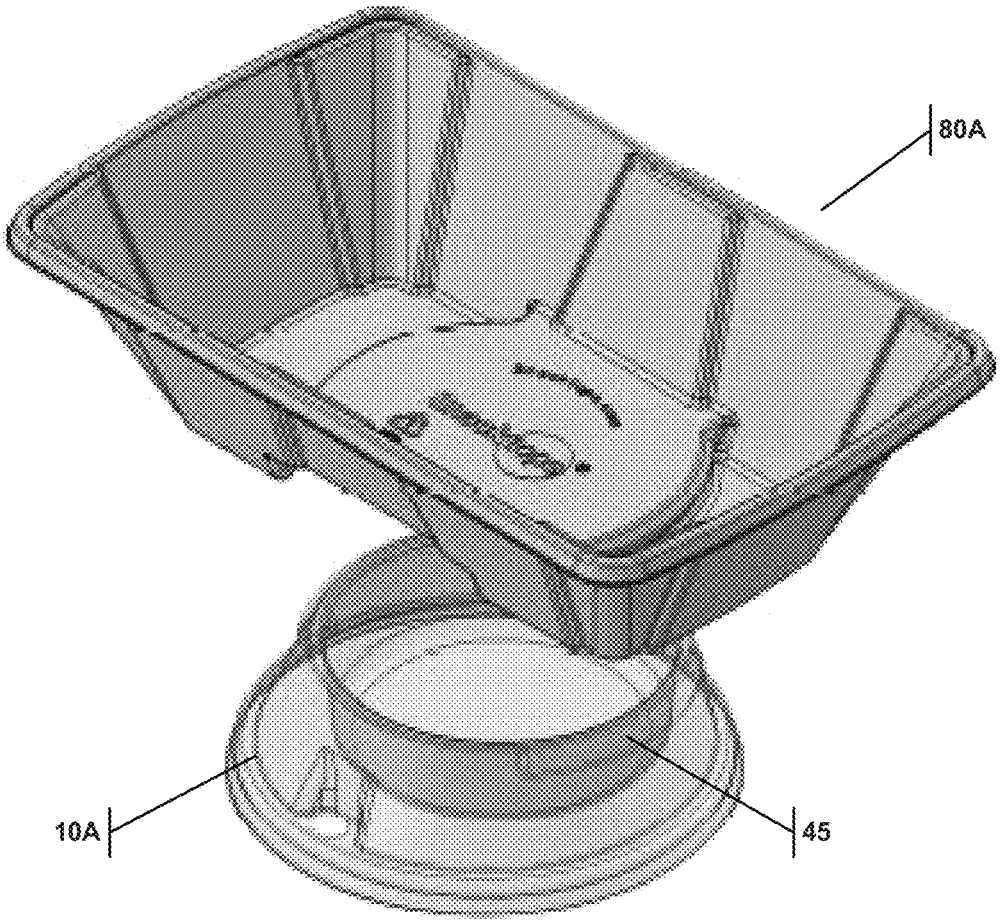
FIG. 3A illustrates the food container lid receiving a food tray to be mounted thereon.
Figure 3C:
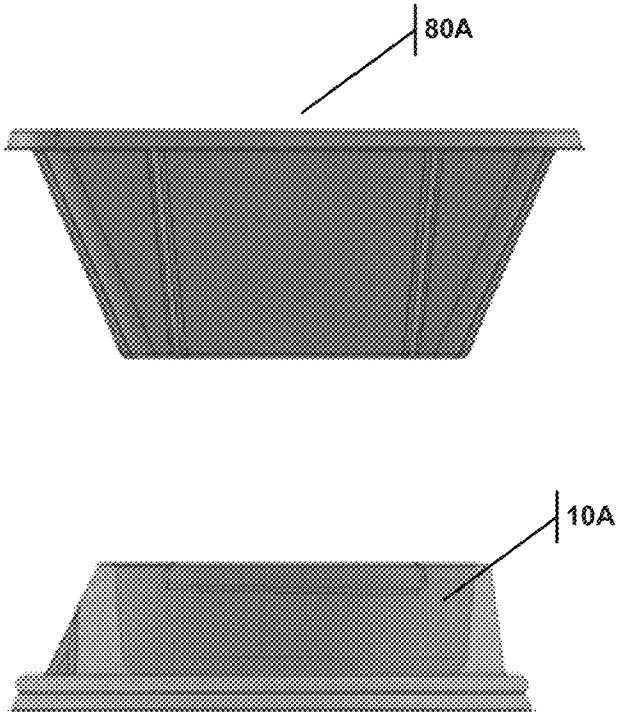
FIG. 3C is a side view of the food container lid receiving the food tray to be mounted thereon.
Figure 3B:
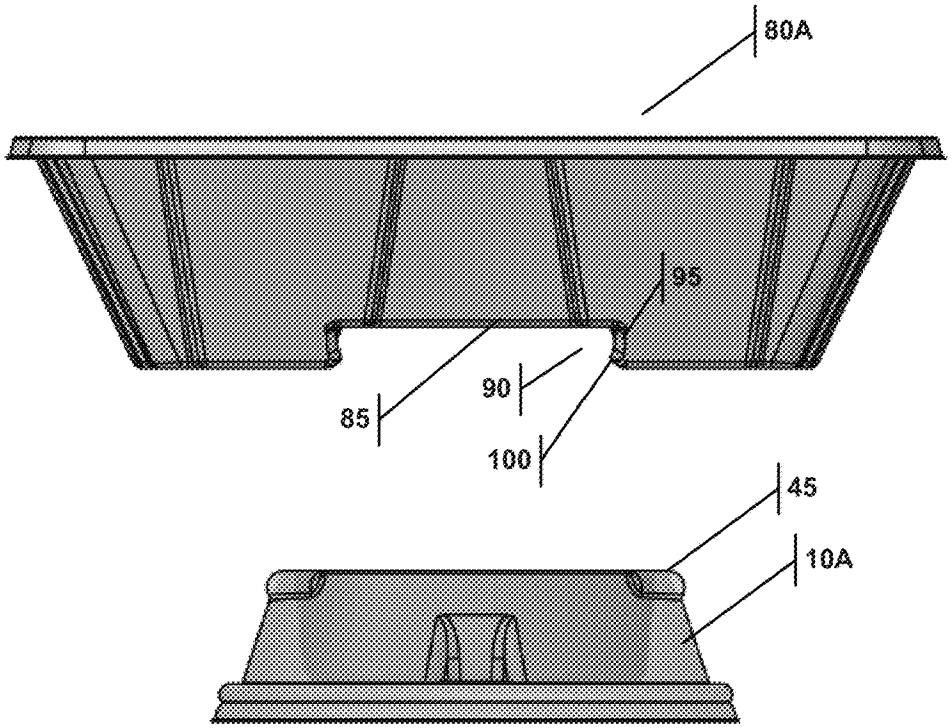
FIG. 3B is a front view of the food container lid receiving the food tray to be mounted thereon.
Figure 3E:
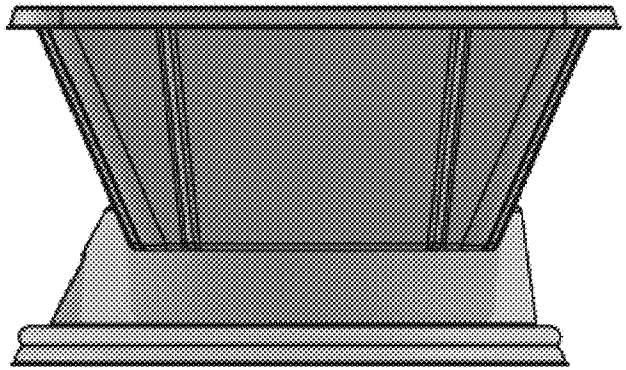
FIG. 3E is a side view of the food container lid with the food tray mounted thereon.
Figure 3D:
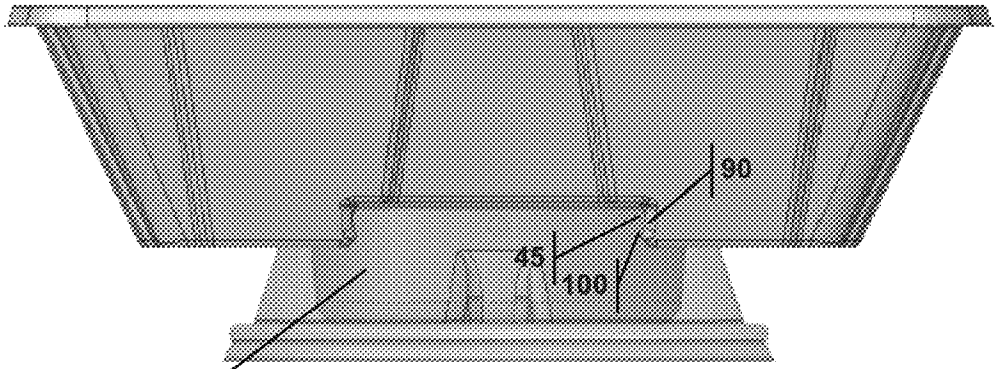
FIG. 3D is a front view of the food container lid with the food tray mounted thereon.

FIGS. 3A through 3C illustrate a second food container/tray 80A about to be mounted to the food container lid 10A via the food container coupling structure 45. As shown in FIG. 3D, the food container/tray 80A has a complementary food container coupling structure 90 with a an inner wall coupling structure 100 that fits under the food compartment coupling structure 45, thus securely mating the food container/tray 80A to the food container lid 10A.

Figure 3F:
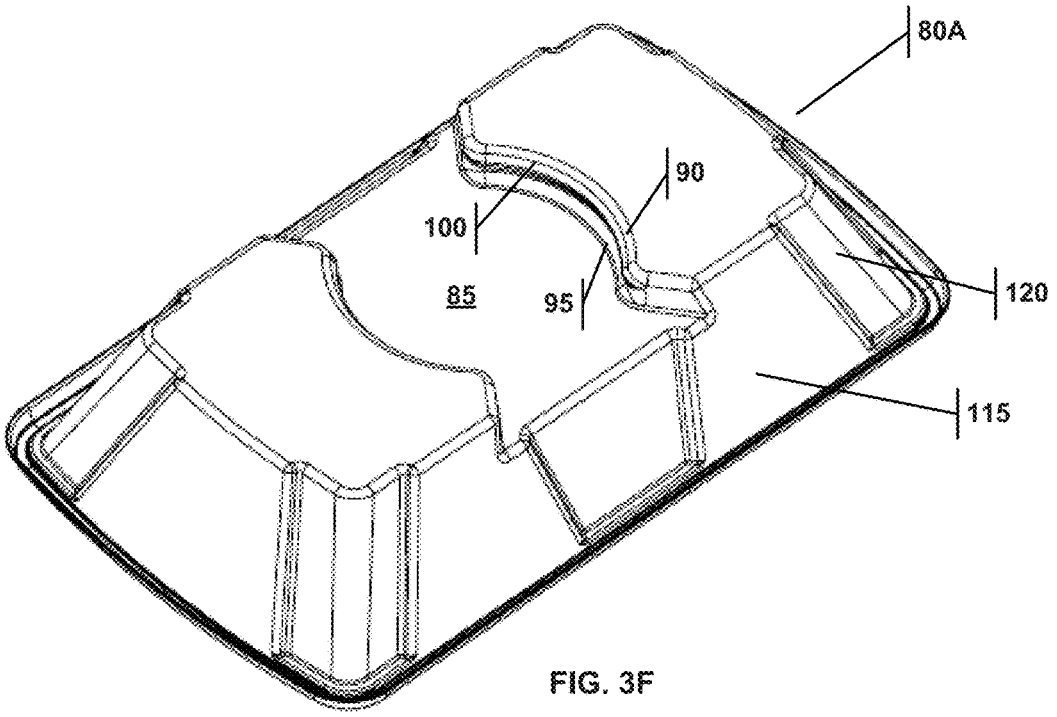
FIG. 3F is an isometric bottom view of a first embodiment of a food tray that may be mounted to the food container lid of FIG. 3A.
Figure 3G:
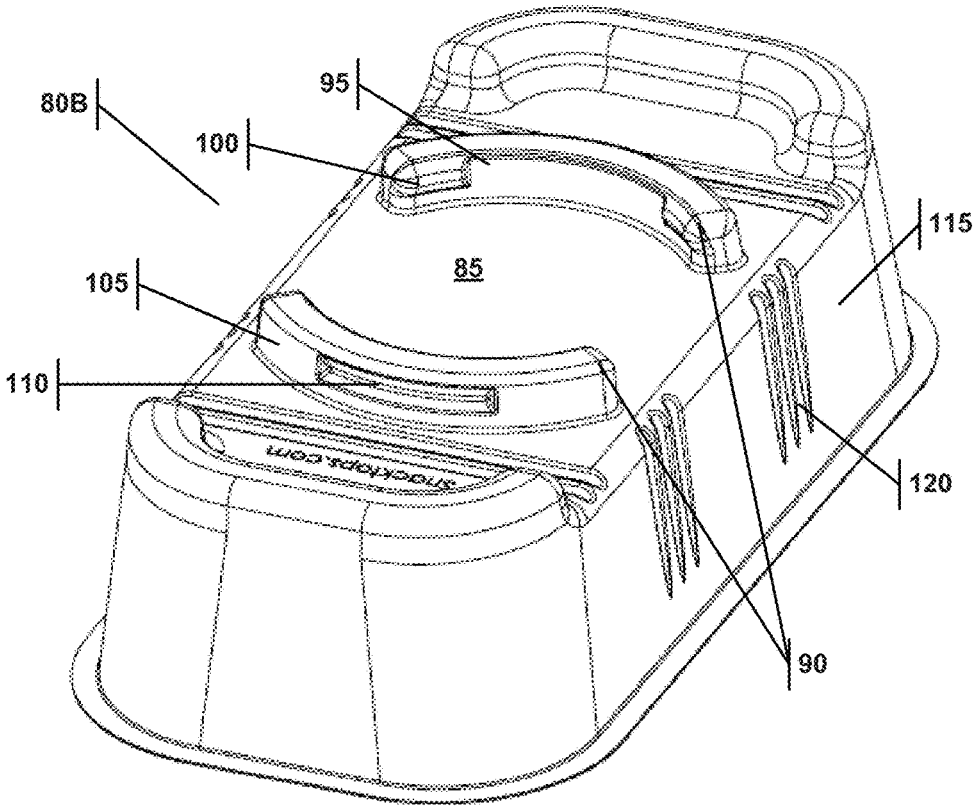
FIG. 3G is an isometric bottom view of a second embodiment of a food tray that may be mounted to the food container lid of FIG. 3A.

FIGS. 3F and 3G show two food container/trays that may be mounted to the food container lid 10A of FIG. 3A. These food container/trays are disclosed in U.S. patent application Ser. No. 15/401,028 entitled "MOUNTABLE FOOD CONTAINER" filed on Jan. 7, 2017, the contents of which are incorporated by reference herein. FIG. 3G is a bottom perspective view of the food container/tray 80A shown in FIGS. 3A-3E. The food container/tray 80A features a bottom 85 and the complementary food container coupling structure 90, which extends from the bottom 85 and is comprised of the inner wall 95 with an inner wall coupling structure 100. The complementary food container coupling structure 90 shown in FIG. 3G mates via the inner wall coupling structure 100 to the food container coupling structure 45 on the food container lid 10A as shown in FIGS. 3D and 3E. Preferably, the food container/tray 80A can also mount to a beverage container, a can, or even a bottle by mating with a compatible coupling structure. It should also be noted that the food container lid 10A may have the cup 15 nested in the food compartment 50, and this nesting does not interfere with the food container coupling structure 45, such that the food container/tray 80A may be mounted securely on the food container lid 10A.

FIG. 3G illustrates yet another the food container/tray 80B with a complementary food container coupling structure 90 that allows the food container 80B to be mounted on top of the food container lid. Preferably, the food container/tray 80B can also mount to a beverage container, a can, or even a bottle by mating with a compatible coupling structure. The embodiment shown in FIG. 3G includes the following features: a bottom 85, the side walls 115, strengthening ribs 120, and the complementary food container coupling structure 90, which extends from the bottom 85 and is comprised of the outer wall 105 with an outer wall coupling structure 110 and the inner wall 95 with an inner wall coupling structure 100. The complementary food container coupling structure 90 shown in FIG. 3F mates via the inner wall coupling structure 100 to the food container coupling structure 45 on the food container lid shown in FIG. 3A.

Figure 3H:
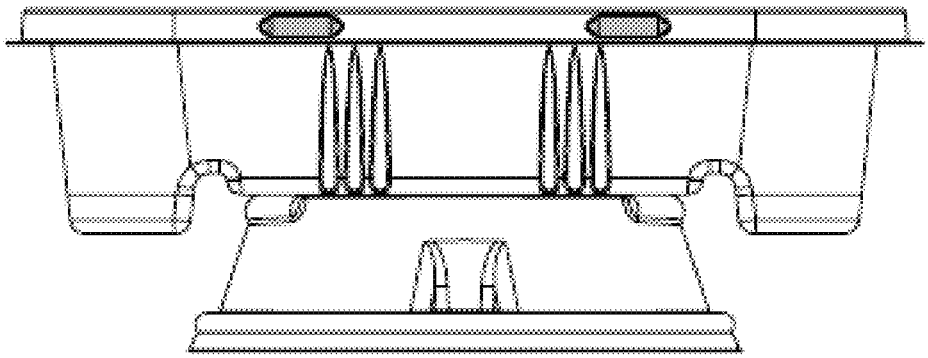
FIG. 3H illustrates a third embodiment of food container lid.
Figure 3I:
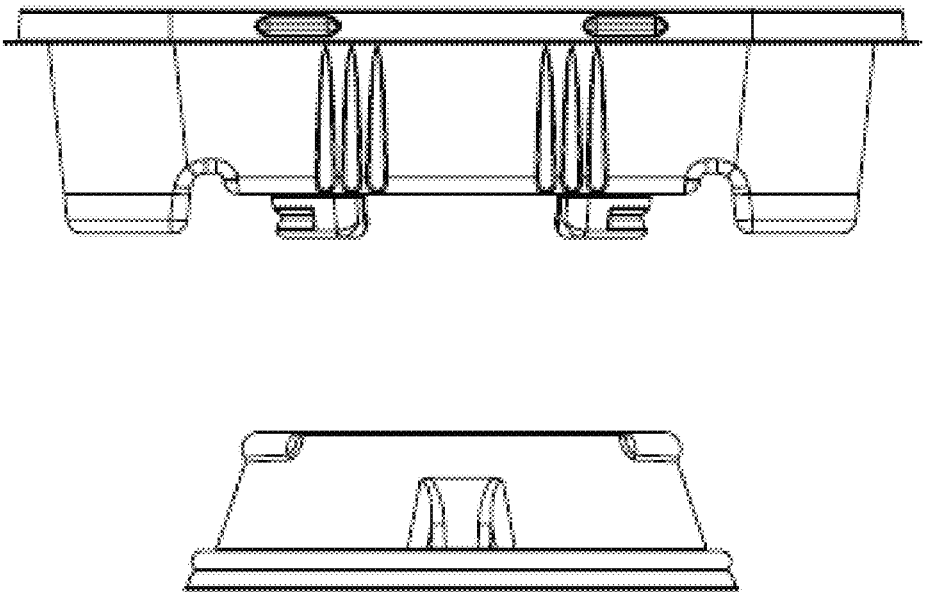
FIG. 3I illustrates a detached view of the third embodiment of food container lid shown in FIG. 3H.

While the food container lids (10A, 10B) illustrate the food container coupling structure 45 on the annular surface outer wall 44, the food container coupling structure 45 may be placed on the near the annular surface rim 42 near the food compartment inner wall 55, much like the cup coupling structure 70. Indeed, the cup coupling structure 70 could be used as the food container coupling structure 45. In this configuration, the complementary food container coupling structure outer wall coupling structure 110 mates with the food container coupling structure. Such a configuration is shown in FIGS. 3H and 3I.

Figure 3J:
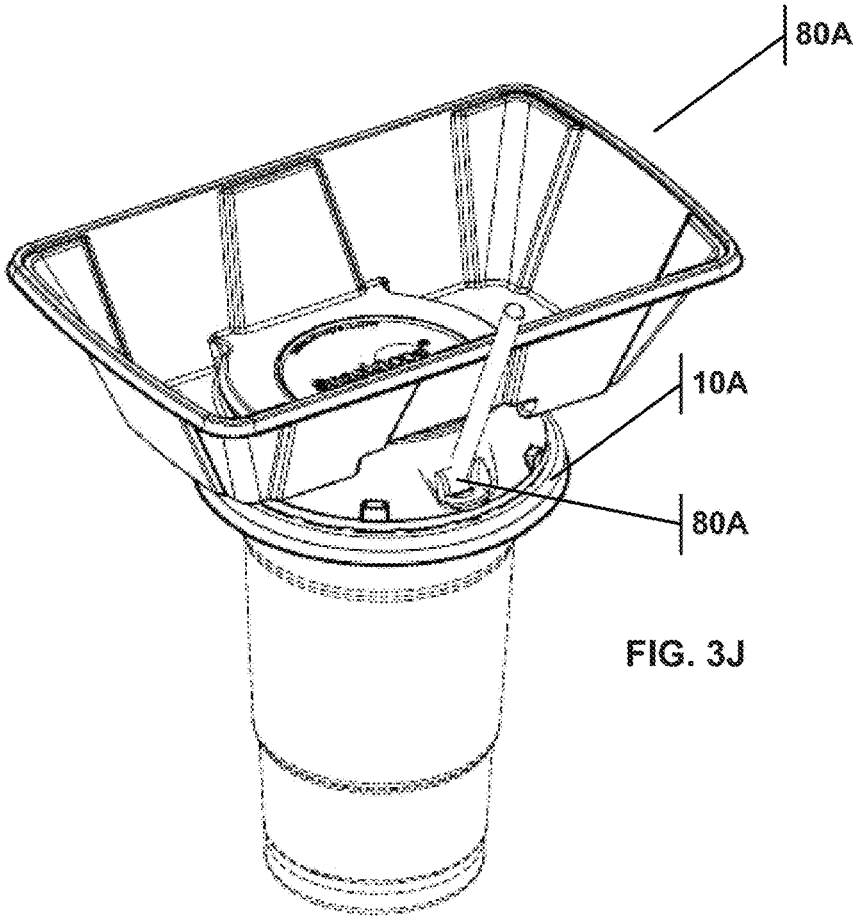
FIG. 3J illustrates the lid of FIG. 3A mounted to a lid and the position of the straw.
Figure 3K:
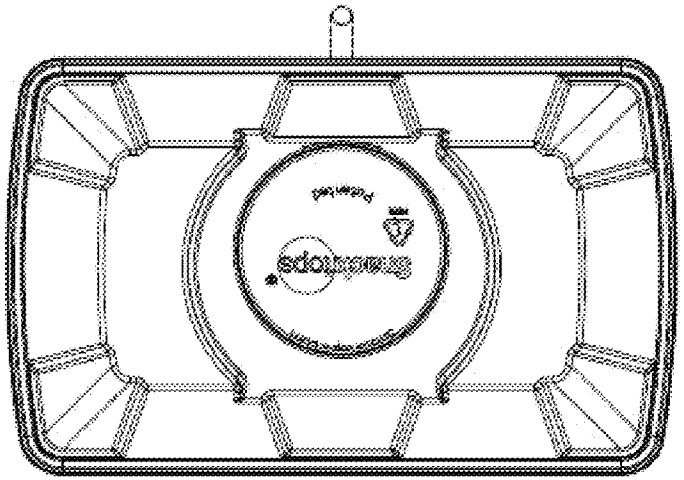
FIG. 3K illustrates the lid of FIG. 3A mounted to a lid and the position of the straw.
Figure 4A:
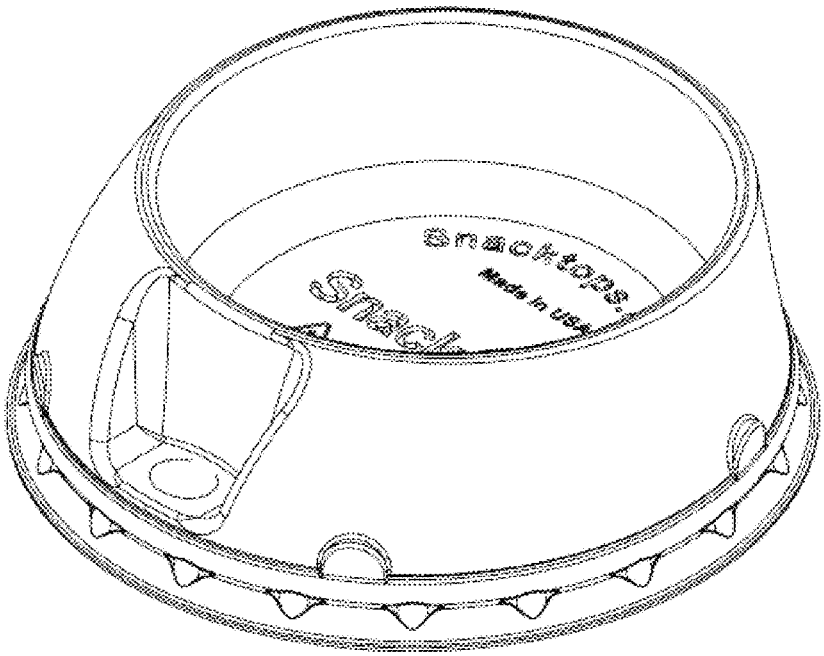
FIG. 4A is a front perspective view of an embodiment of the food container lid.
Figure 4B:
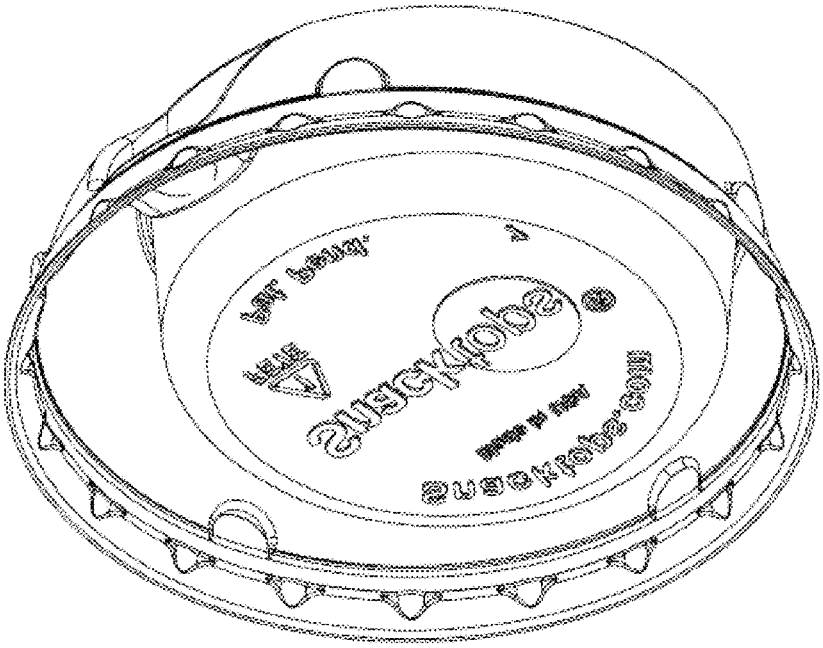
FIG. 4B is a back perspective view of the food container lid of FIG. 4A.
Figure 4C:
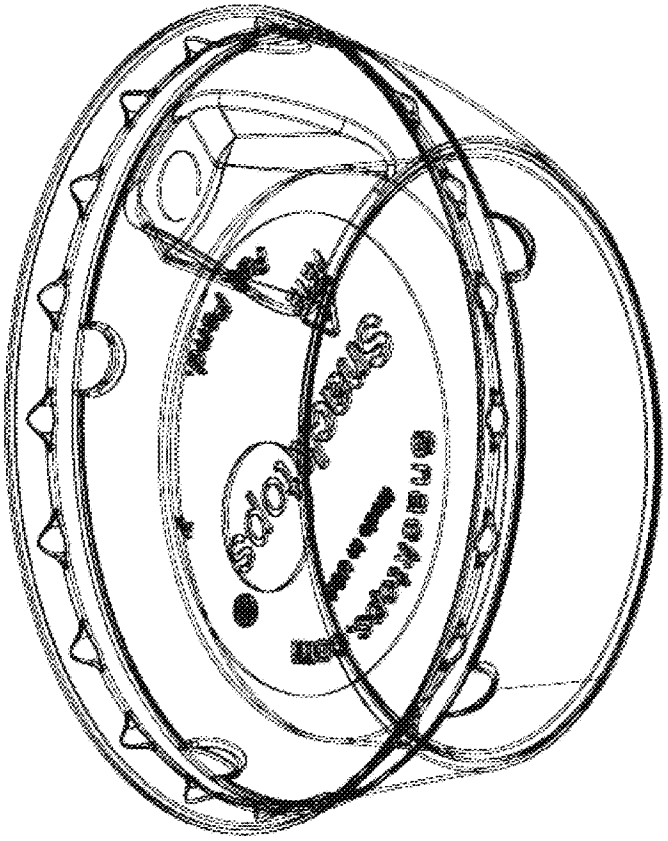
FIG. 4C is a front perspective view of the food container lid of FIG. 4A, shown made of transparent material.
Figure 4D:
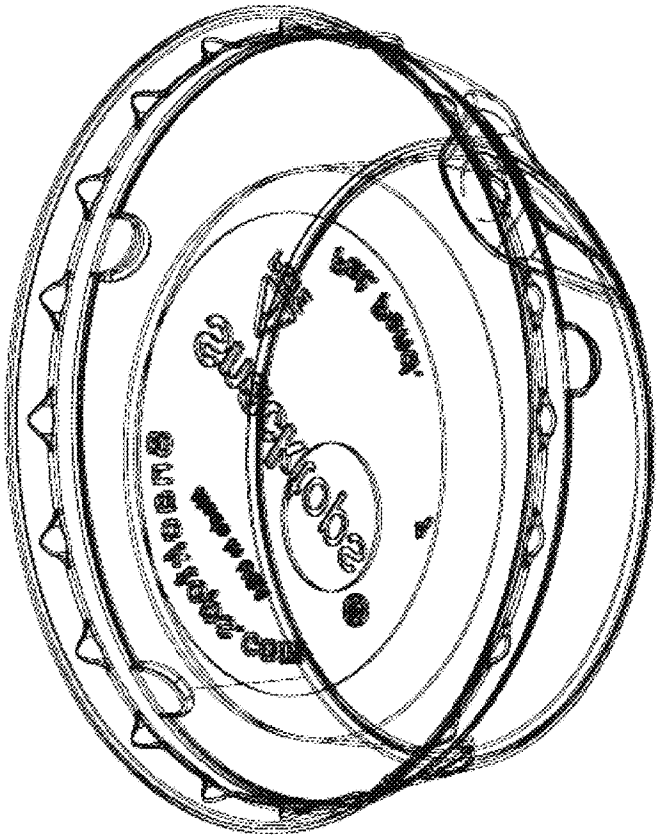
FIG. 4D is a back perspective view of the food container lid of FIG. 4A, shown made of transparent material.
Figure 4E:
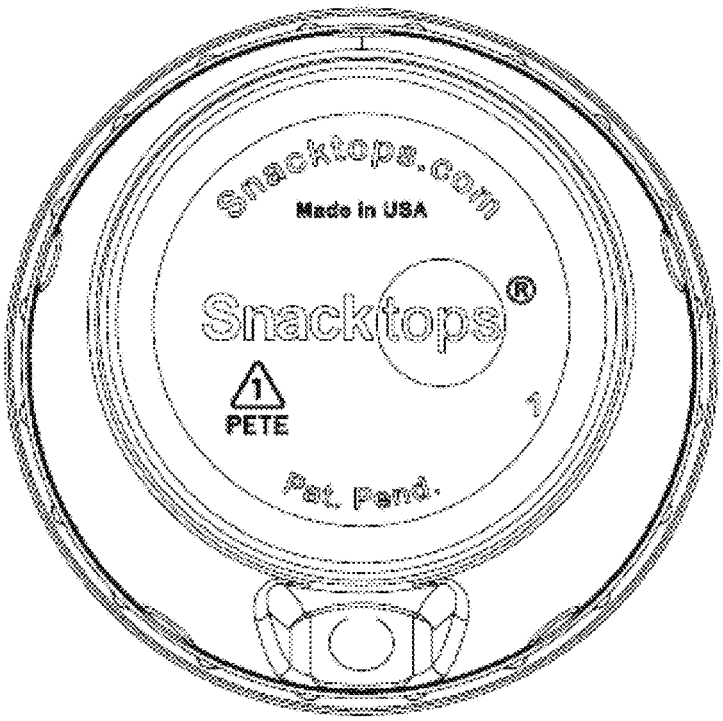
FIG. 4E is a front view of the food container lid of FIG. 4A.
Figure 4F:
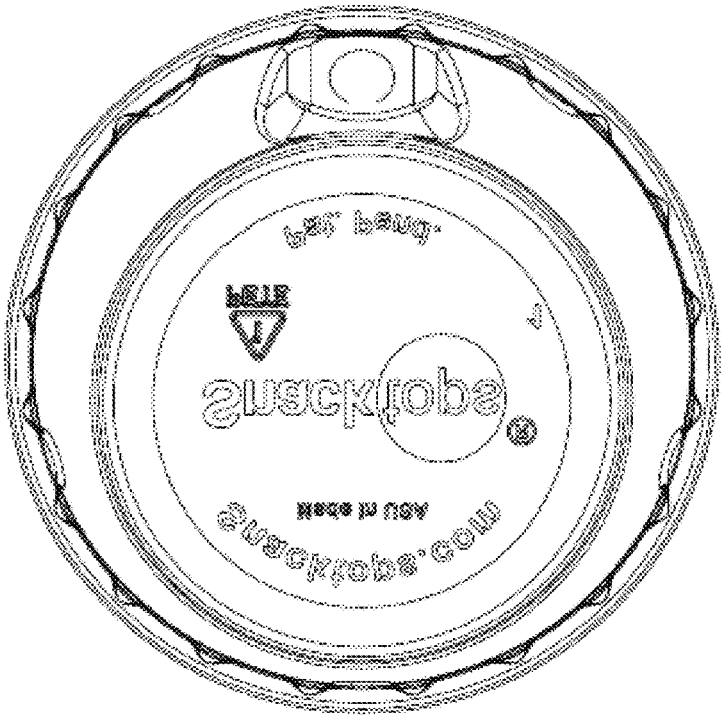
FIG. 4F is a bottom view of the food container lid of FIG. 4A.
Figure 4G:
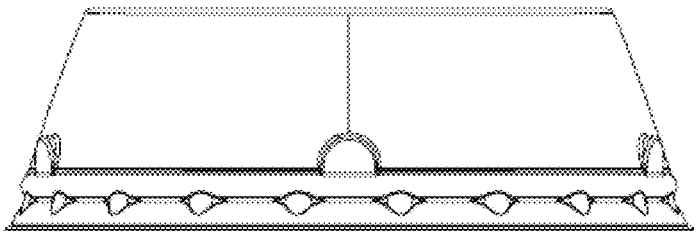
FIG. 4G is a bottom-side view of the food container lid of FIG. 4A.
Figure 4H:
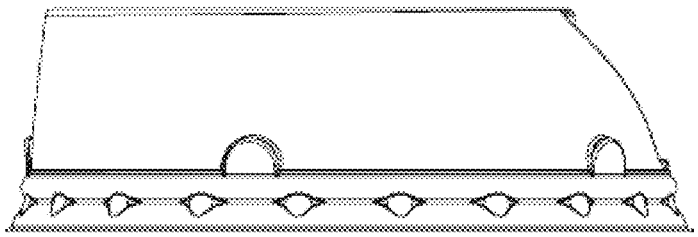
FIG. 4H is a left-side view of the food container lid of FIG. 4A.
Figure 4I:
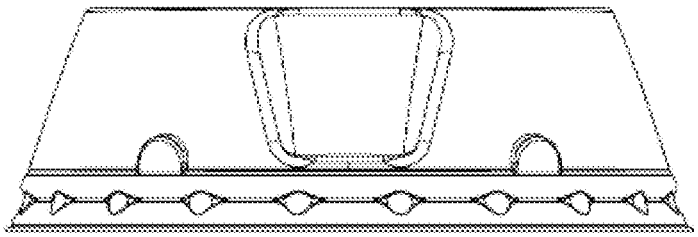
FIG. 4I is a top-side view of the food container lid of FIG. 4A.
Figure 4J:
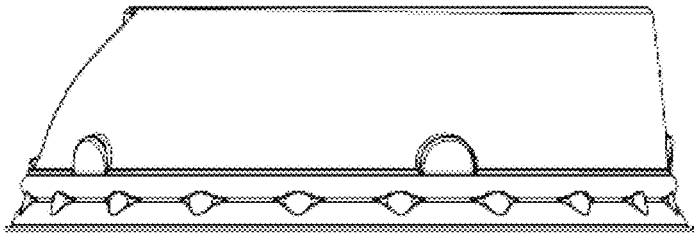
FIG. 4J is a right-side view of the food container lid of FIG. 4A.
Figure 4K:
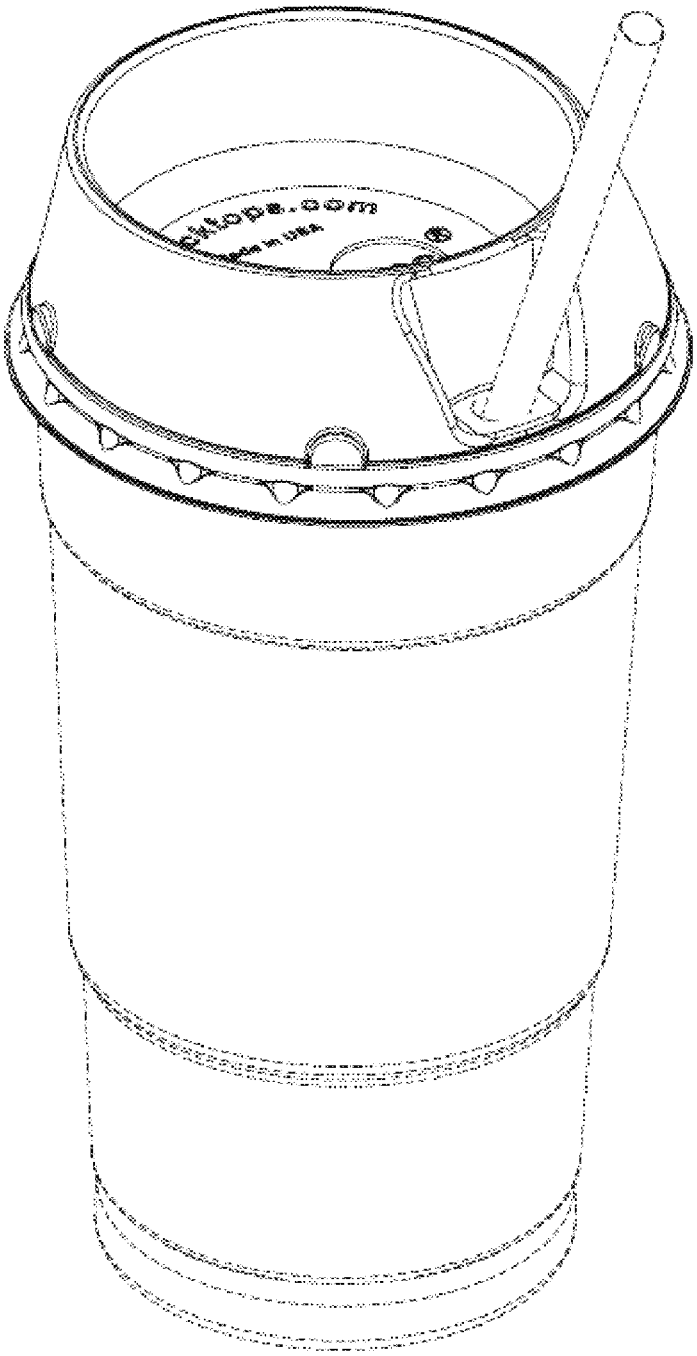
FIG. 4K shows the food container lid of FIG. 4A mounted to a beverage container.
Figure 5A:
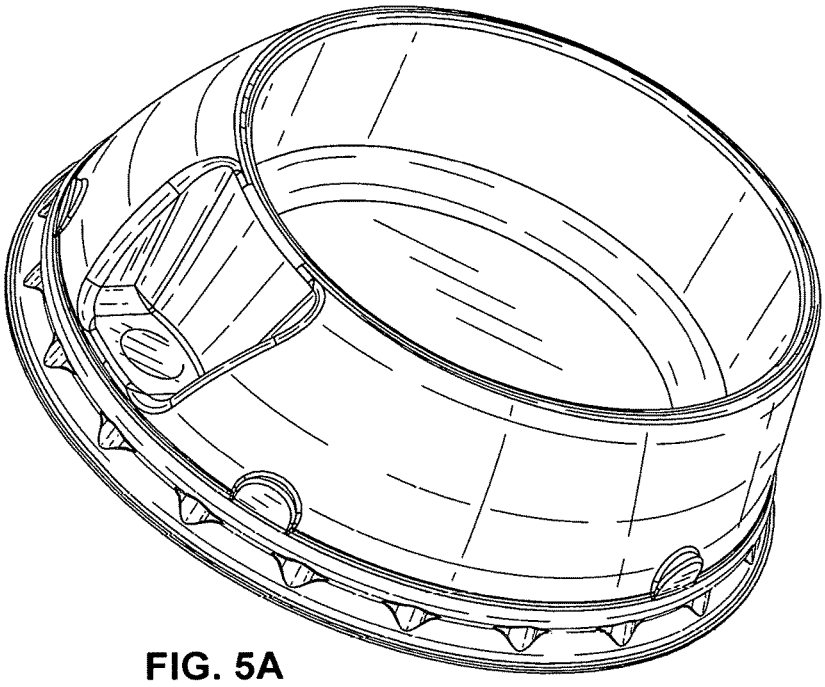
FIG. 5A is a front perspective view of an embodiment of the food container lid.
Figure 5B:
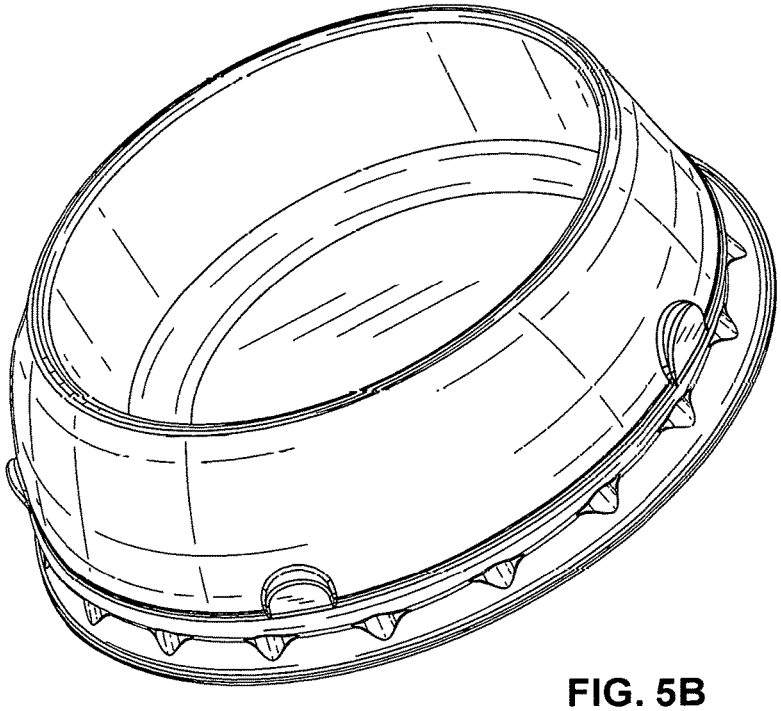
FIG. 5B is a back perspective view of the food container lid of FIG. 5A.
Figure 5C:
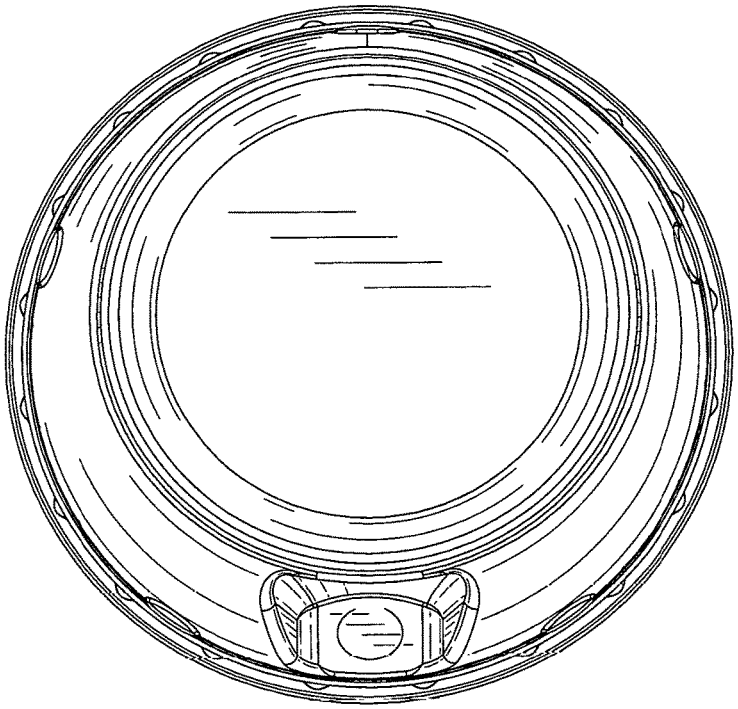
FIG. 5C is a front view of the food container lid of FIG. 5A.
Figure 5D:
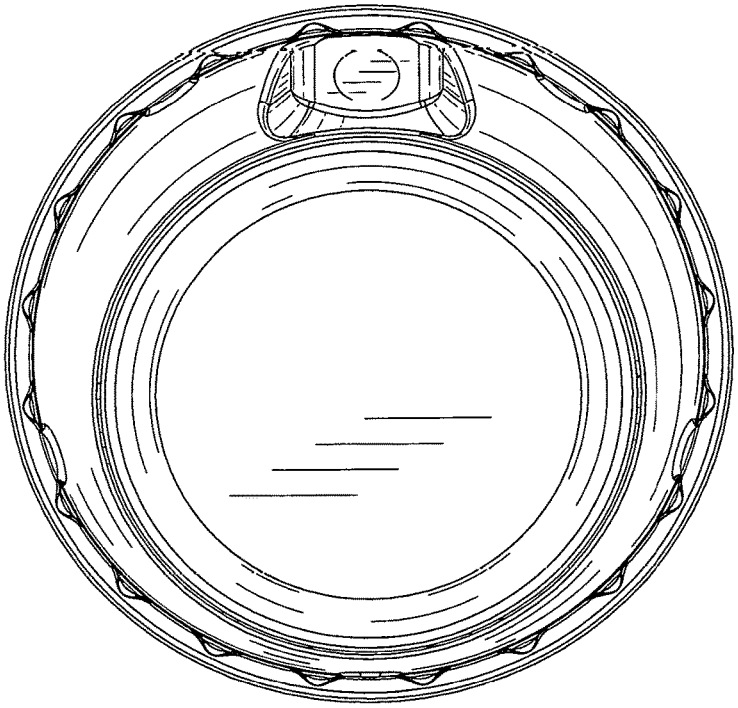
FIG. 5D is a back view of the food container lid of FIG. 5A.
Figure 5E:
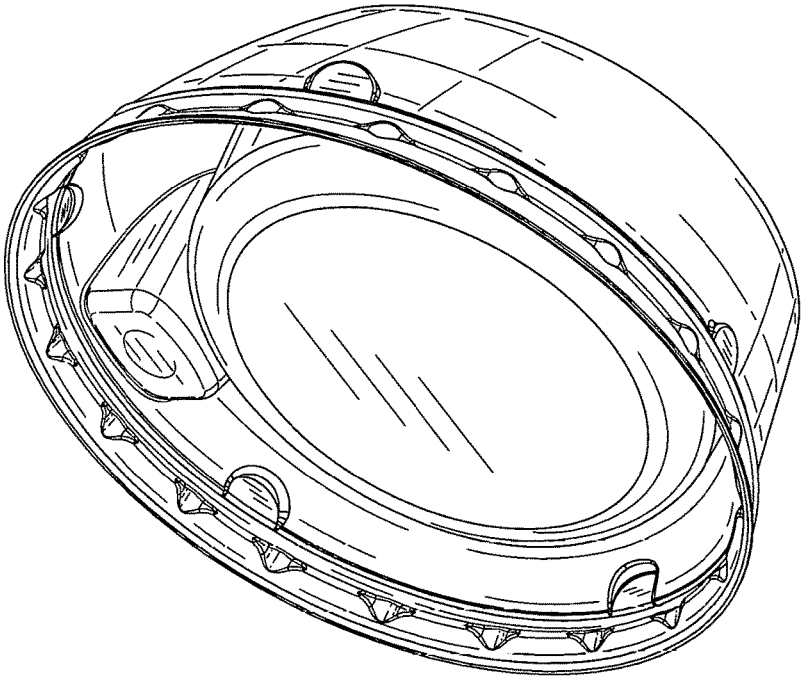
FIG. 5E is a back perspective view of the food container lid of FIG. 5A.
Figure 5F:
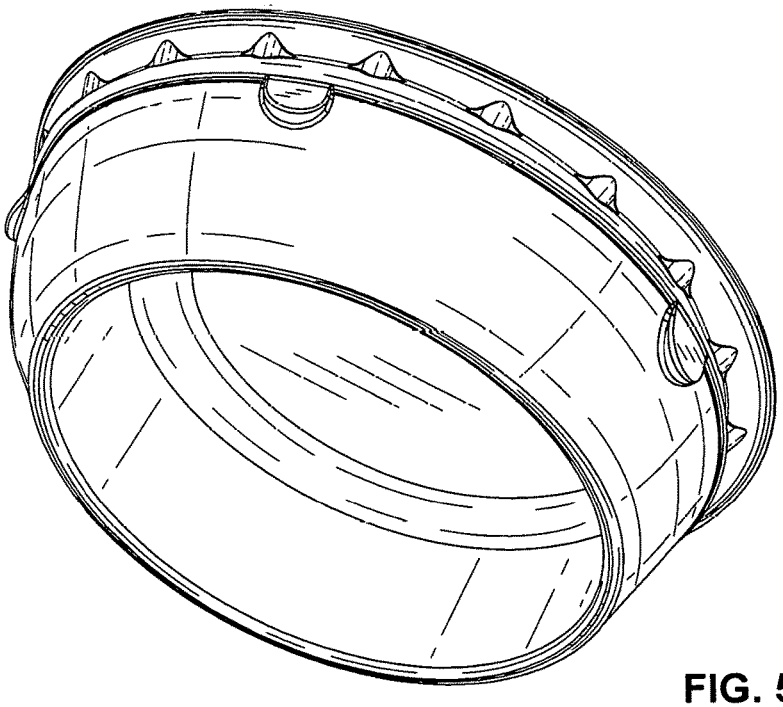
FIG. 5F is a side perspective view of the food container lid of FIG. 5A.
Figure 5G:
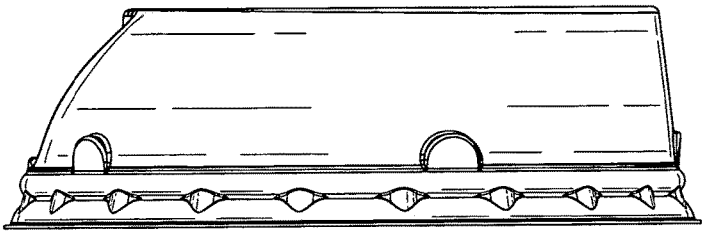
FIG. 5G is a right-side view of the food container lid of FIG. 5A.
Figure 5H:
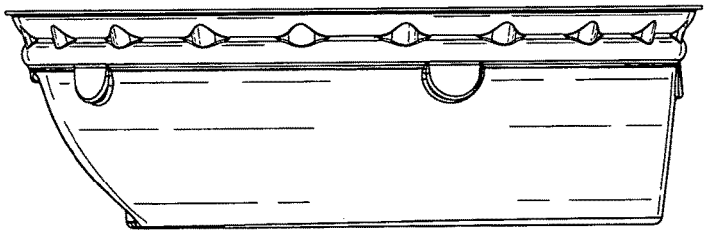
FIG. 5H is a left-side view of the food container lid of FIG. 5A.
Figure 5I:
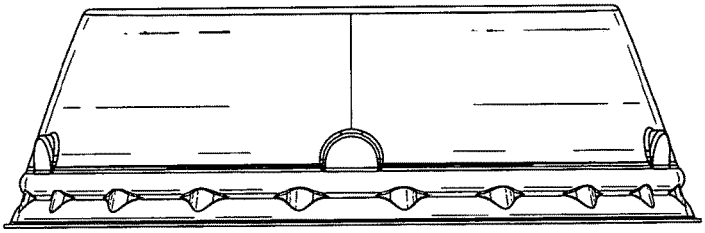
FIG. 5I is a top-side view of the food container lid of FIG. 5A.
Figure 5J:
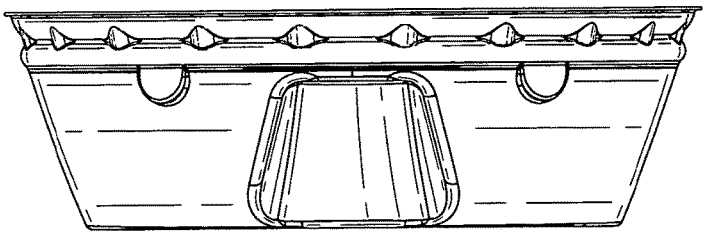
FIG. 5J is a bottom-side view of the food container lid of FIG. 5A.
Figure 6A:
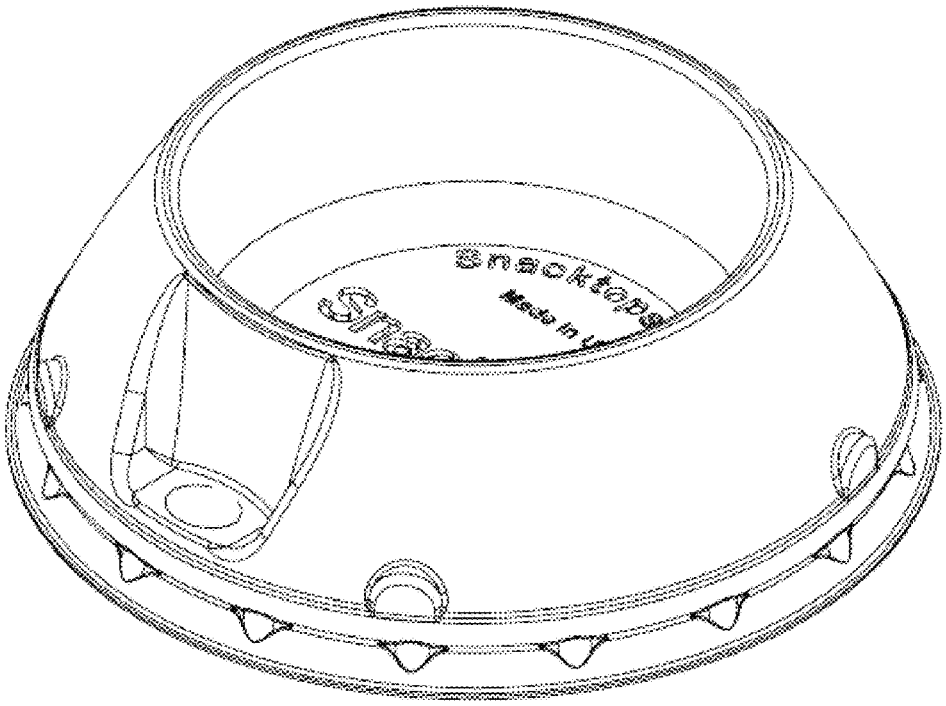
FIG. 6A is a front perspective view of an embodiment of the food container lid.
Figure 6B:
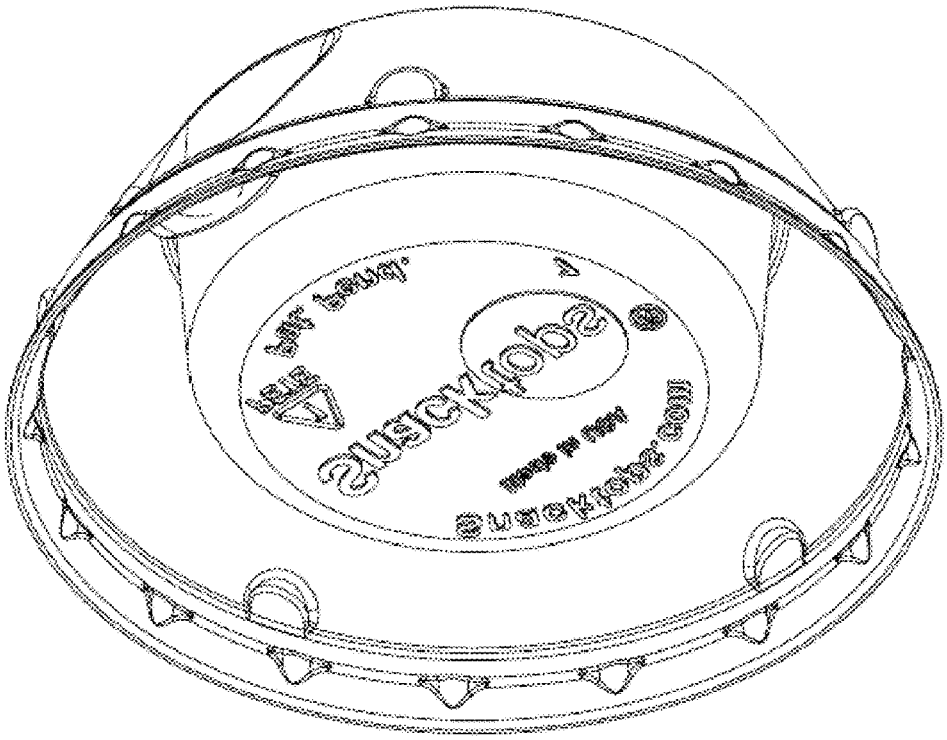
FIG. 6B is a back perspective view of the food container lid of FIG. 6A.
Figure 6C:
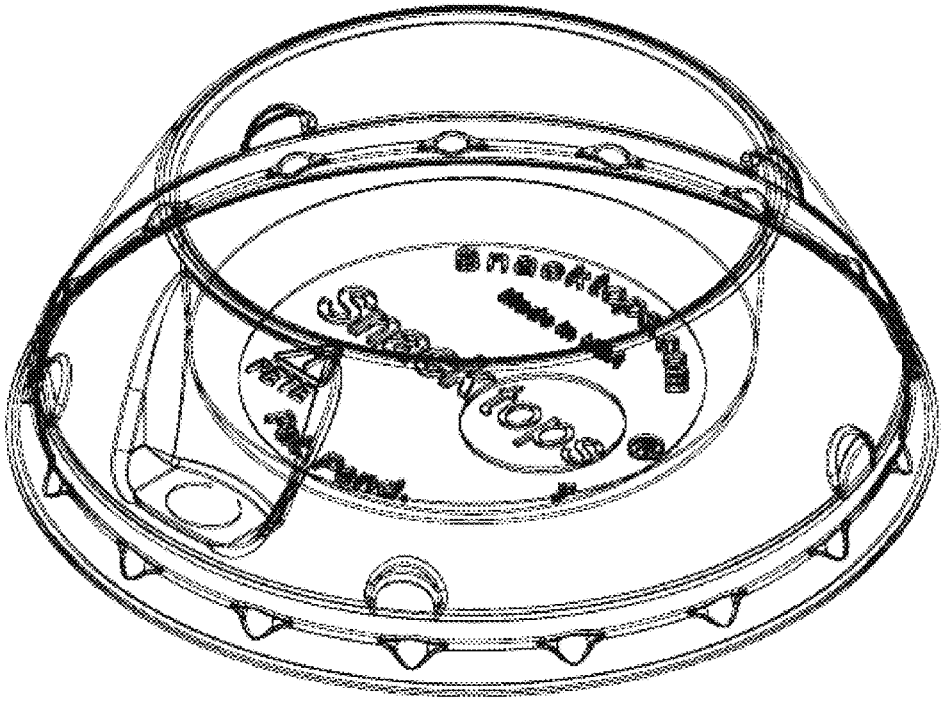
FIG. 6C is a front perspective view of the food container lid of FIG. 6A, shown made of transparent material.
Figure 6D:
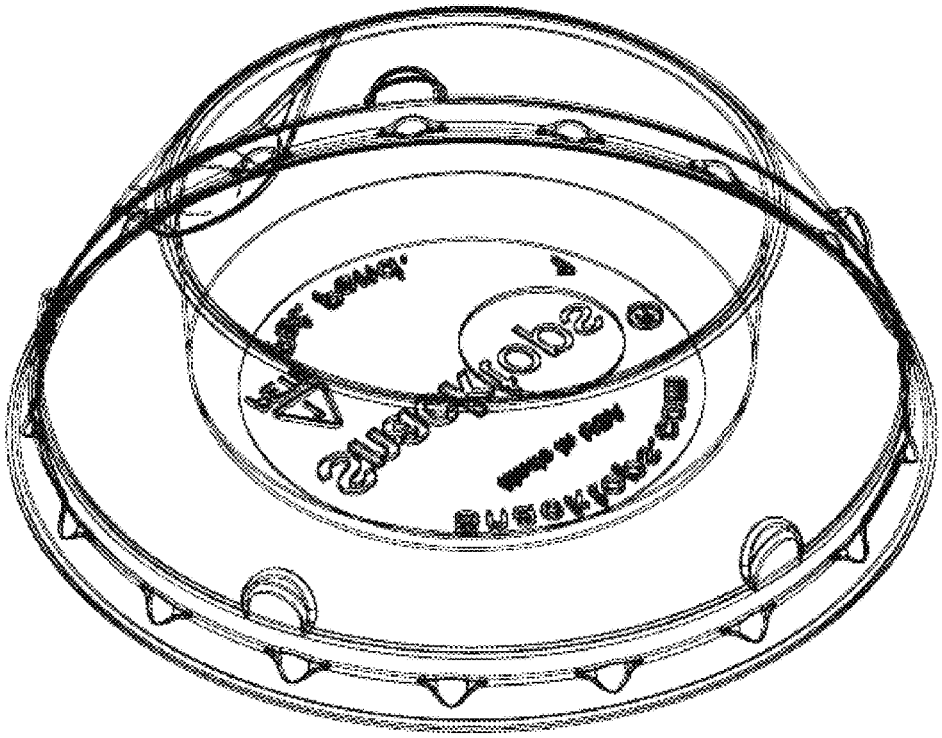
FIG. 6D is a back perspective view of the food container lid of FIG. 6A, shown made of transparent material
Figure 6E:
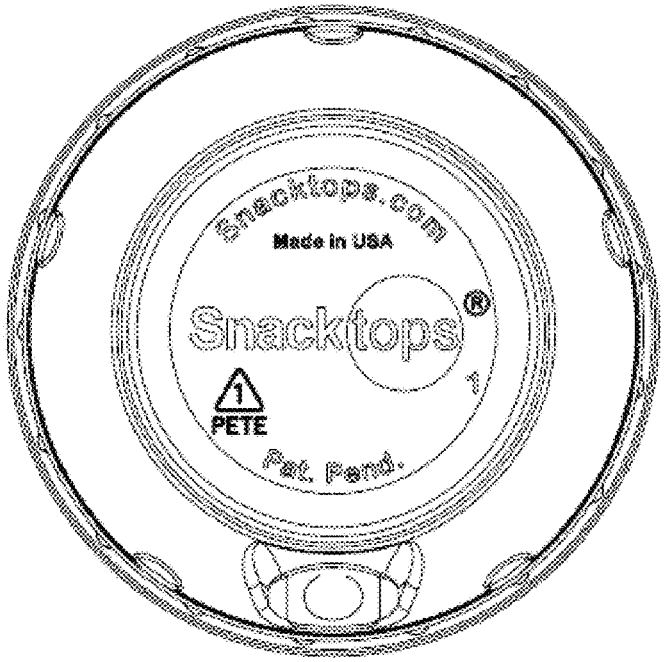
FIG. 6E is a front view of the food container lid of FIG. 6A.
Figure 6F:
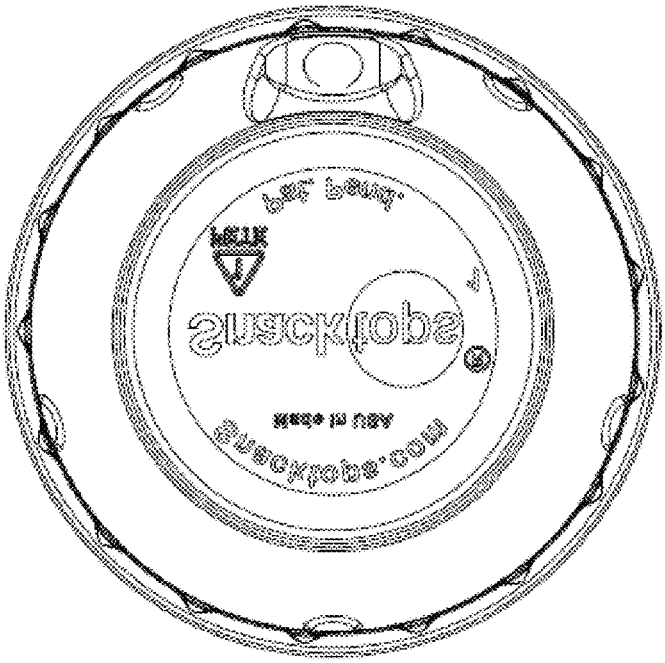
FIG. 6F is a bottom view of the food container lid of FIG. 6A.
Figure 6G:
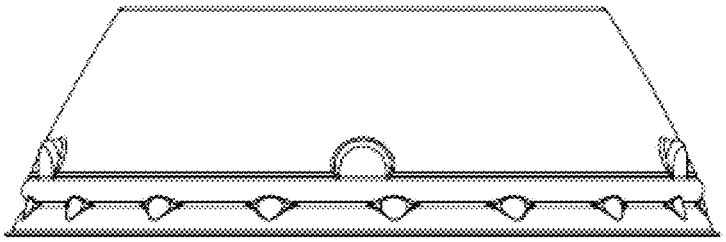
FIG. 6G is a bottom-side view of the food container lid of FIG. 6A.
Figure 6H:
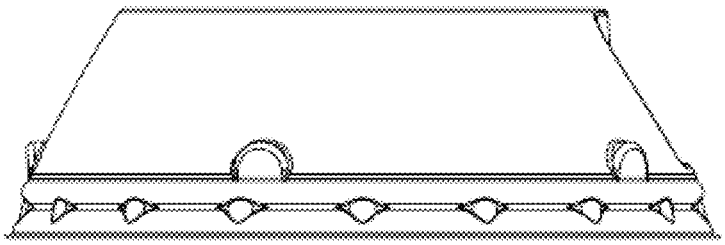
FIG. 6H is a left-side view of the food container lid of FIG. 6A.
Figure 6I:
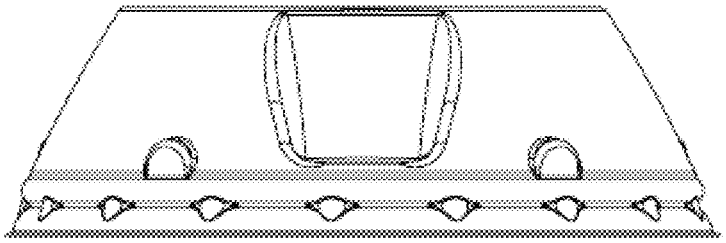
FIG. 6I is a top-side view of the food container lid of FIG. 6A.
Figure 6J:
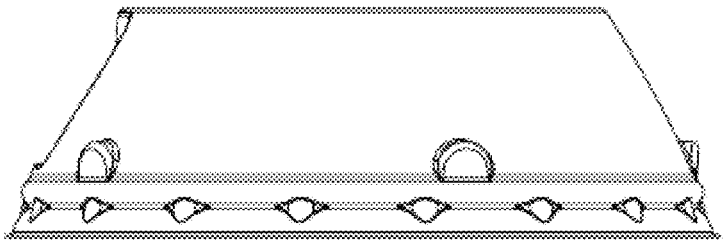
FIG. 6J is a right-side view of the food container lid of FIG. 6A.
Figure 6K:
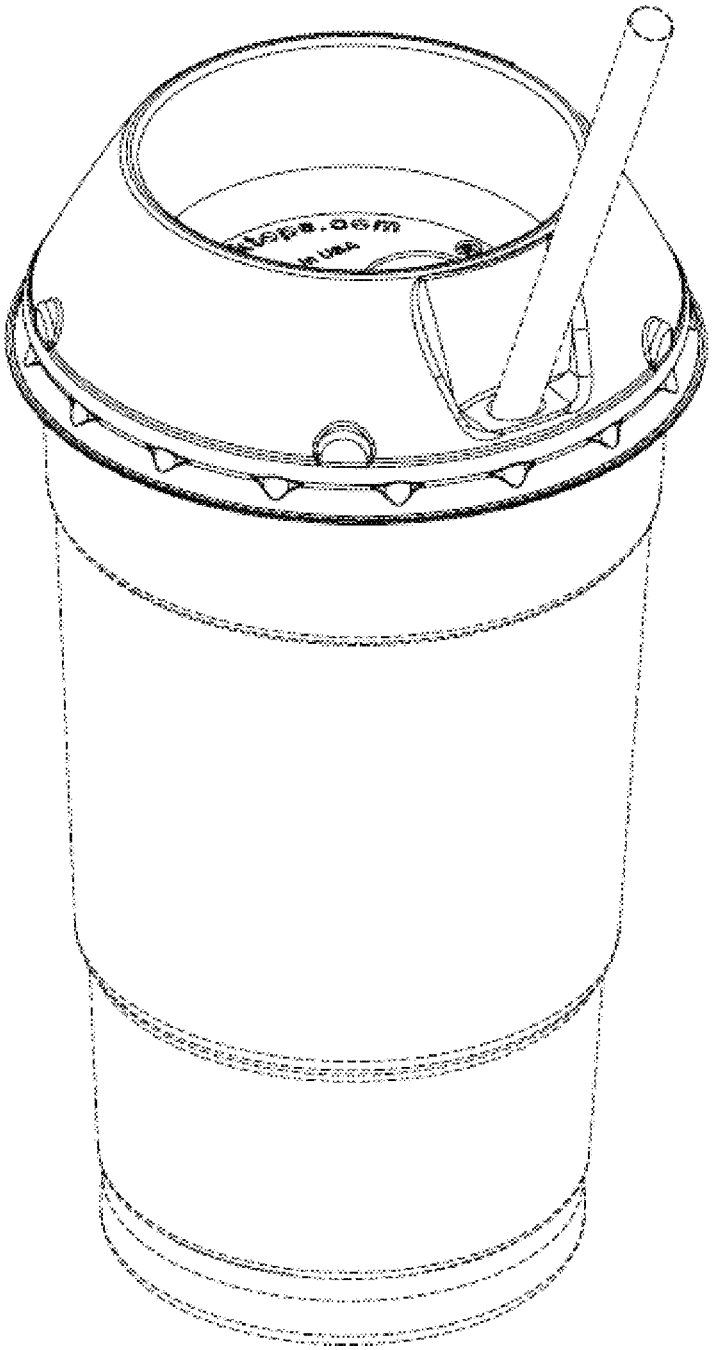
FIG. 6K shows the food container lid of FIG. 6A mounted to a beverage container.
Figure 7A:
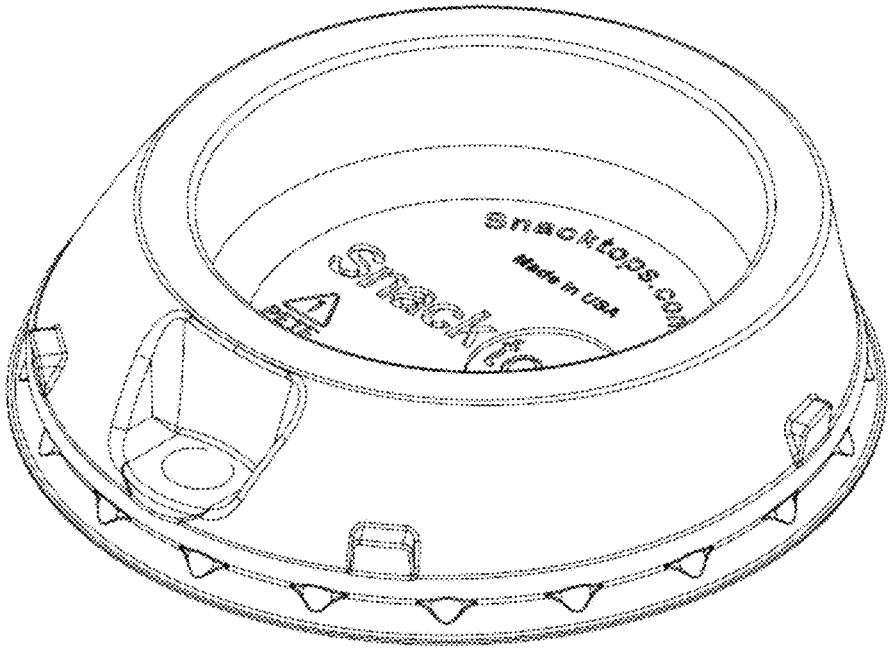
FIG. 7A is a front perspective view of an embodiment of the food container lid.
Figure 7B:
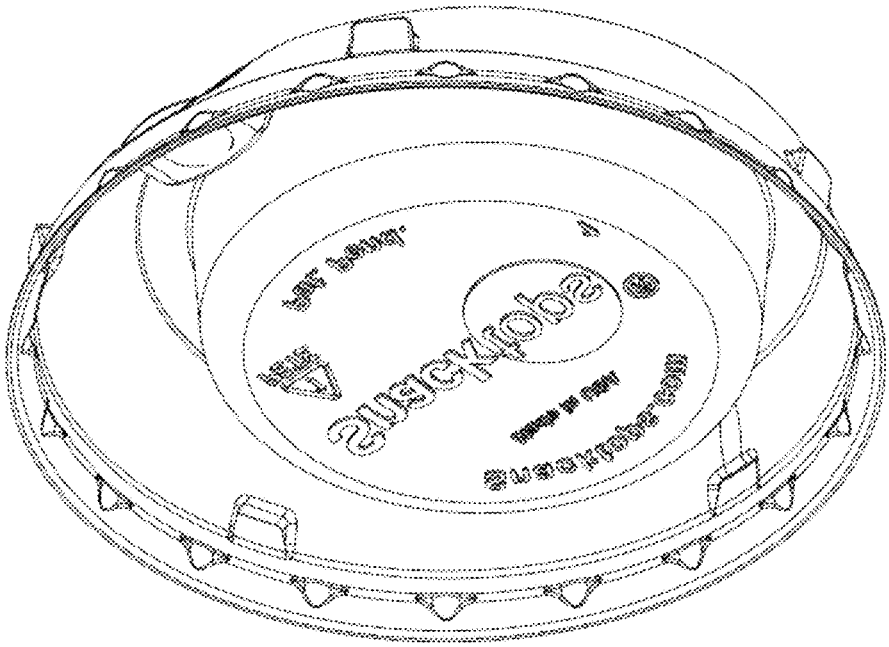
FIG. 7B is a back perspective view of the food container lid of FIG. 7A.
Figure 7C:
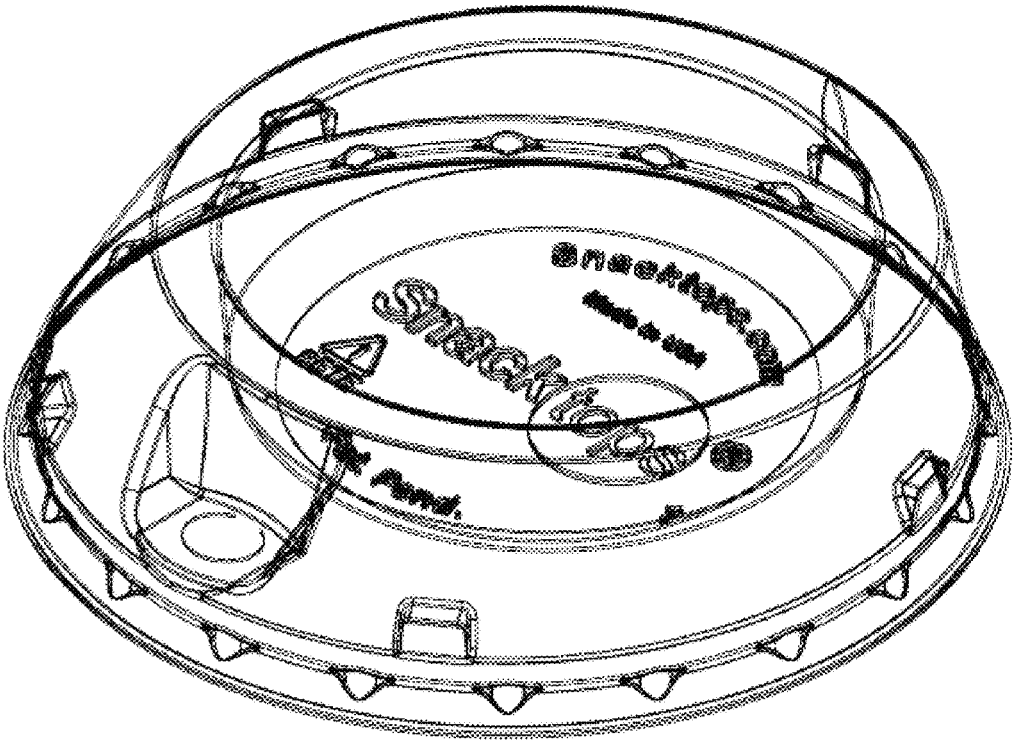
FIG. 7C is a front perspective view of the food container lid of FIG. 7A, shown made of transparent material.
Figure 7D:
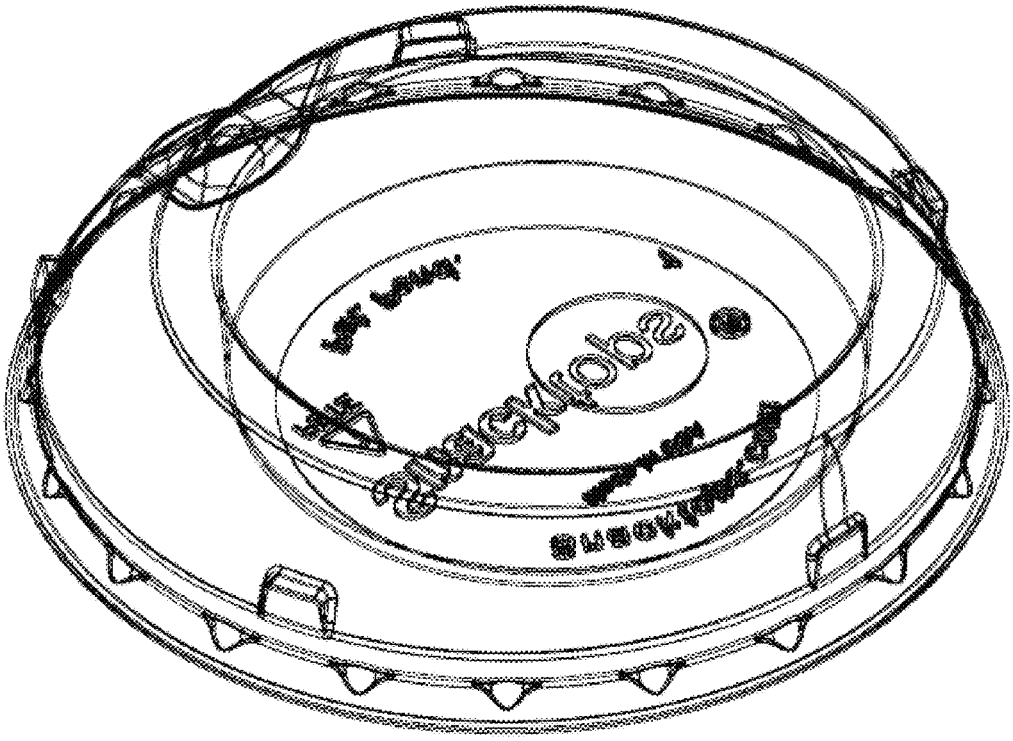
FIG. 7D is a back perspective view of the food container lid of FIG. 7A, shown made of transparent material.
Figure 7E:
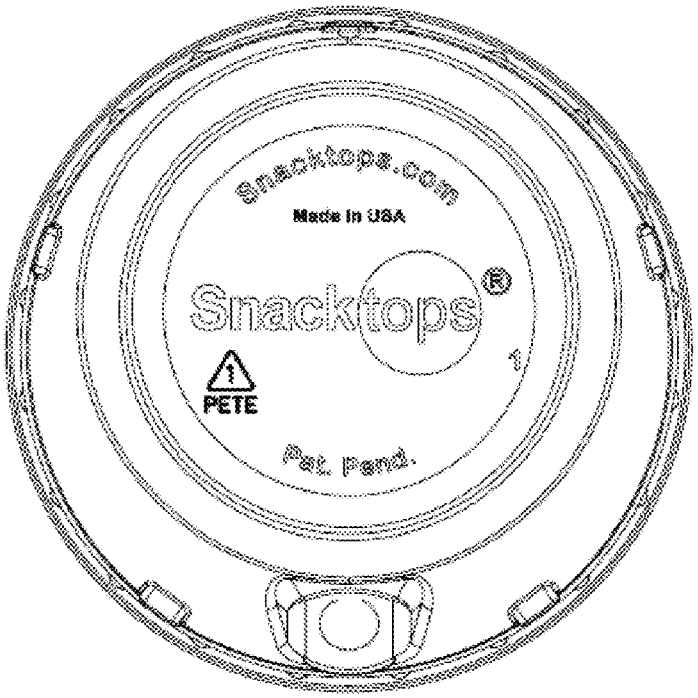
FIG. 7E is a front view of the food container lid of FIG. 7A.
Figure 7F:
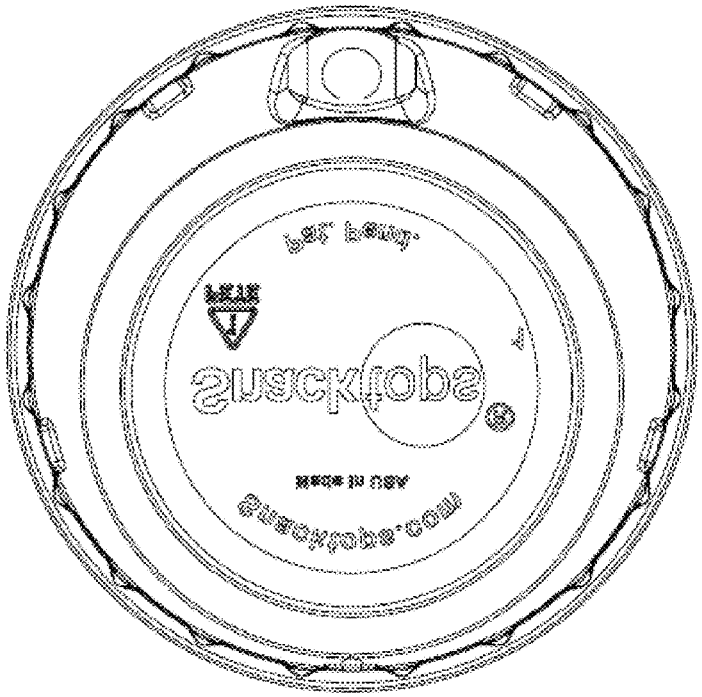
FIG. 7F is a bottom view of the food container lid of FIG. 7A.
Figure 7G:
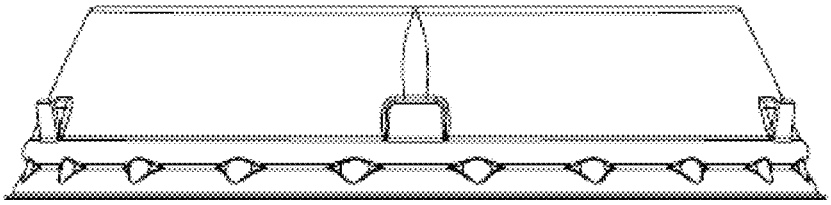
FIG. 7G is a bottom-side view of the food container lid of FIG. 7A.
Figure 7H:
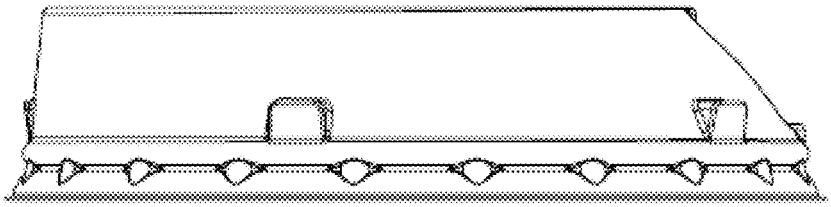
FIG. 7H is a left-side view of the food container lid of FIG. 7A.
Figure 7I:
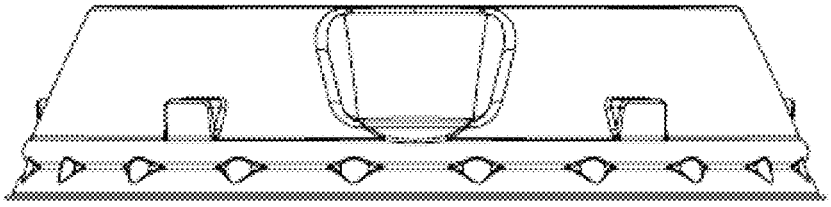
FIG. 7I is a top-side view of the food container lid of FIG. 7A.
Figure 7J:
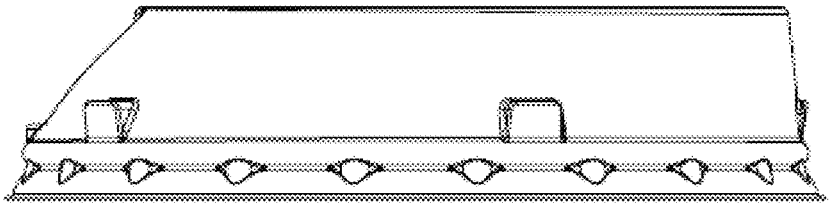
FIG. 7J is a right-side view of the food container lid of FIG. 7A.
Figure 7K:
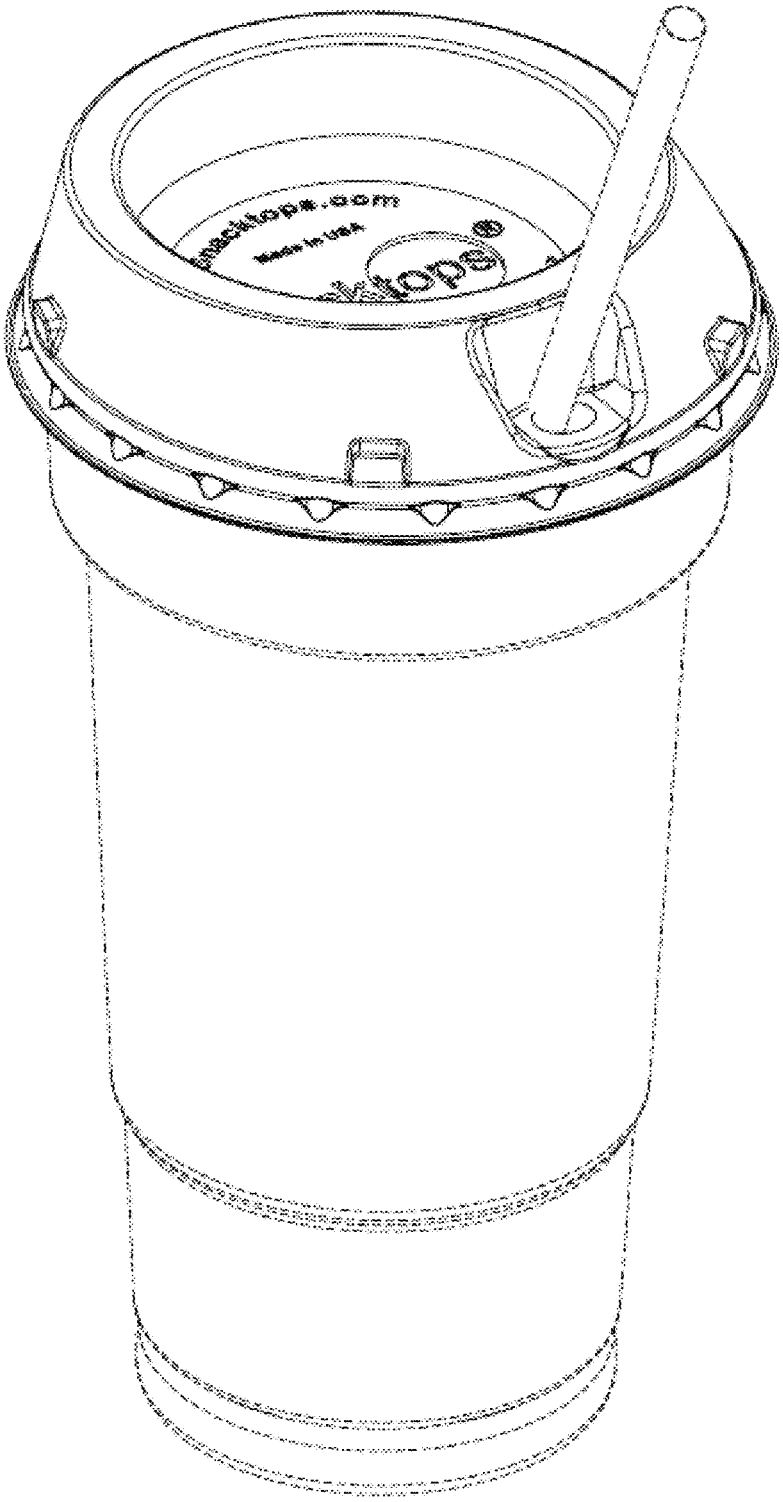
FIG. 7K shows the food container lid of FIG. 7A mounted to a beverage container.
Figure 8A:
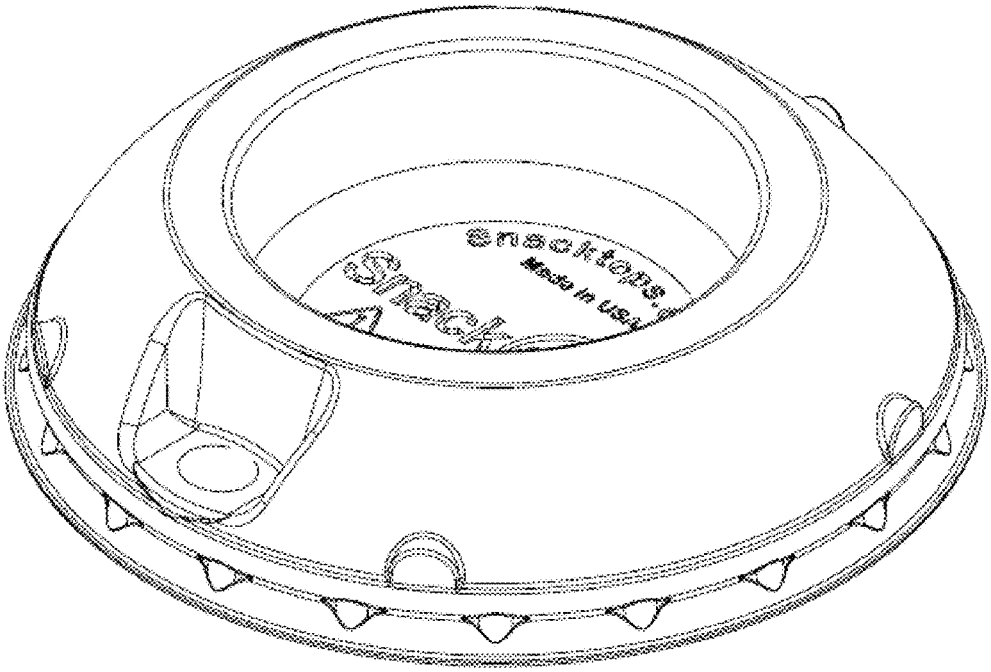
FIG. 8A is a front perspective view of an embodiment of the food container lid.
Figure 8B:
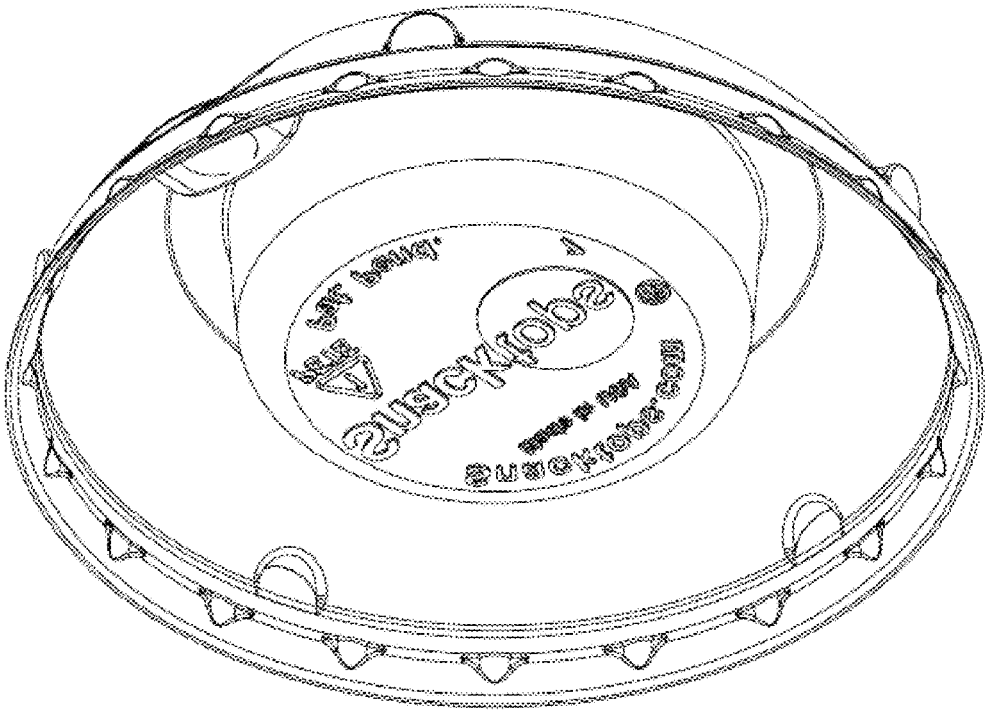
FIG. 8B is a back perspective view of the food container lid of FIG. 8A.
Figure 8C:
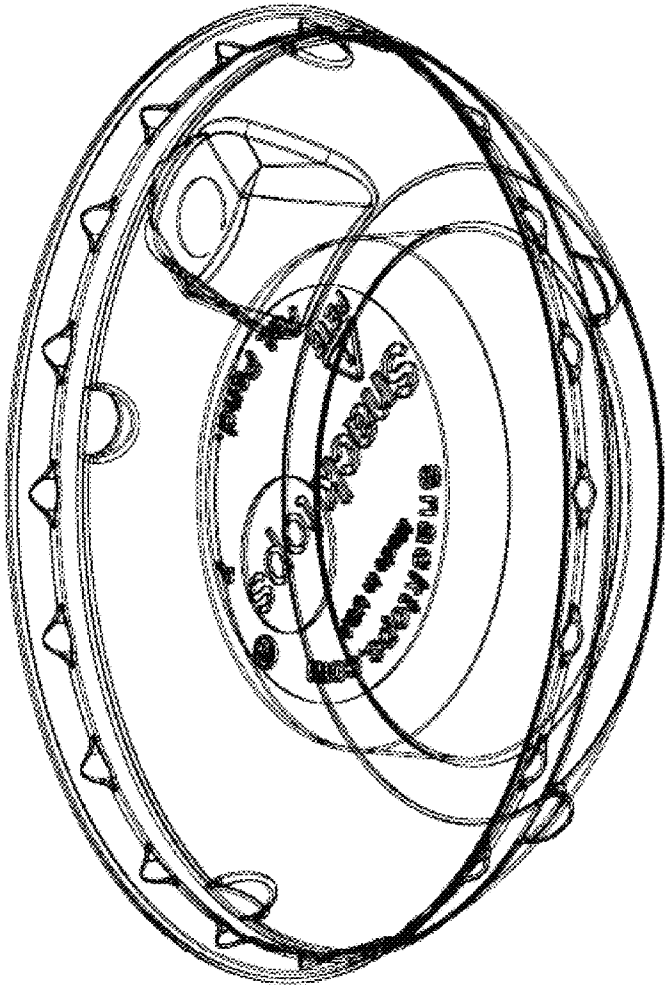
FIG. 8C is a front perspective view of the food container lid of FIG. 8A, shown made of transparent material.
Figure 8D:
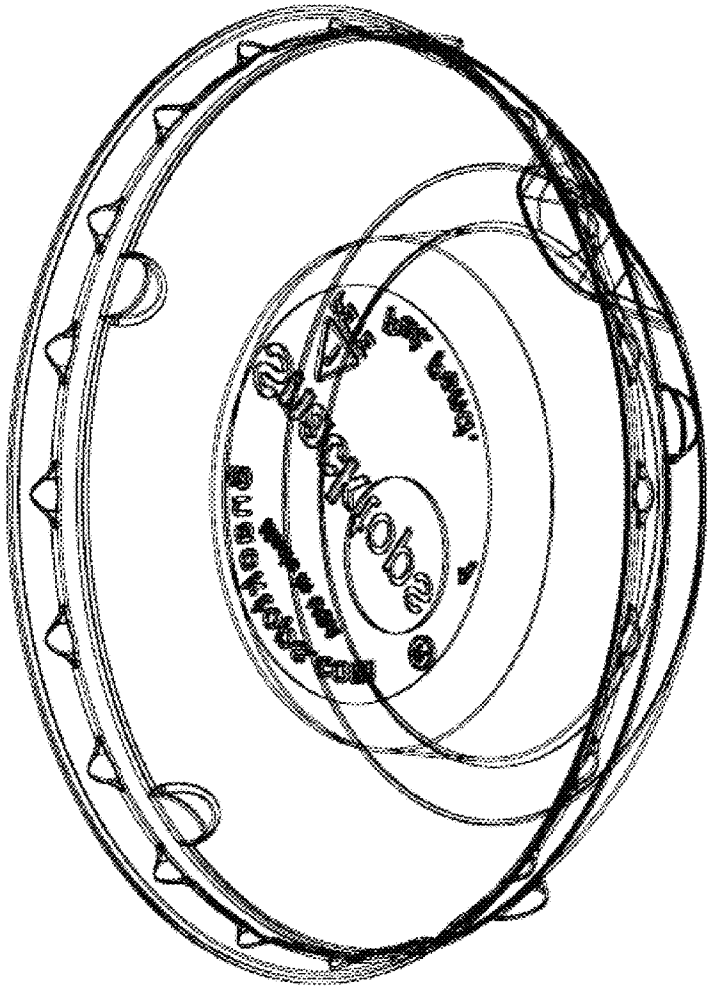
FIG. 8D is a back perspective view of the food container lid of FIG. 8A, shown made of transparent material.
Figure 8E:
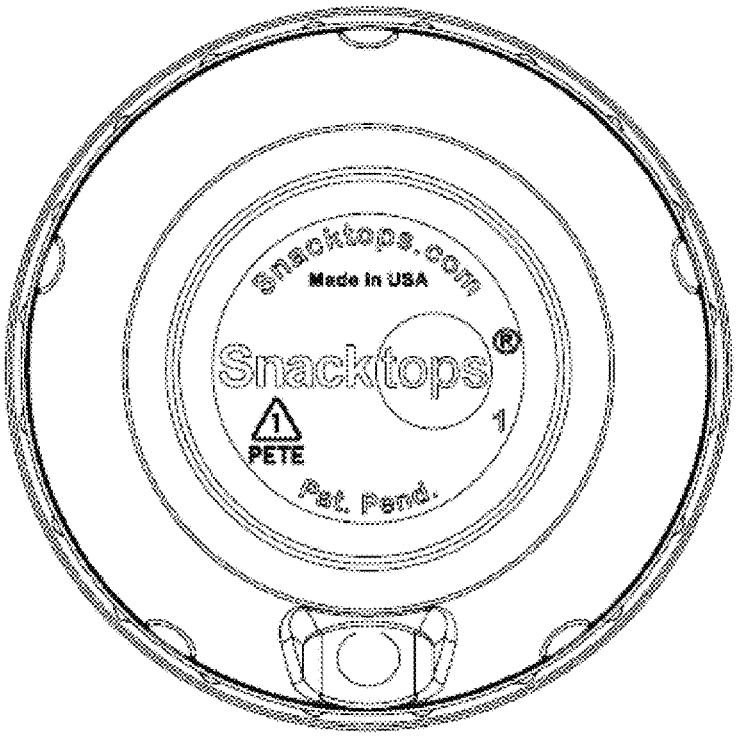
FIG. 8E is a front view of the food container lid of FIG. 8A.
Figure 8F:
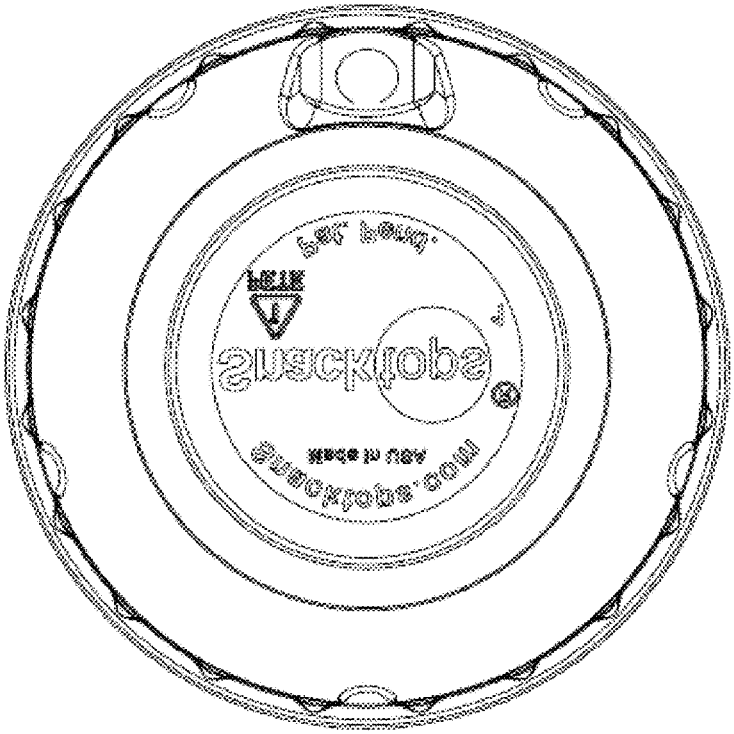
FIG. 8F is a bottom view of the food container lid of FIG. 8A.
Figure 8G:
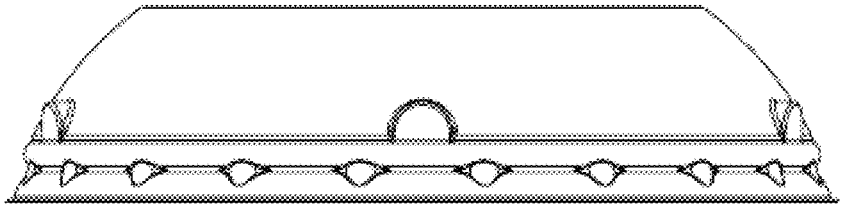
FIG. 8G is a bottom-side view of the food container lid of FIG. 8A.
Figure 8H:
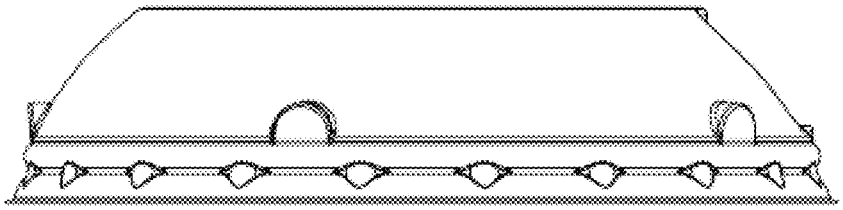
FIG. 8H is a left-side view of the food container lid of FIG. 8A.
Figure 8I:
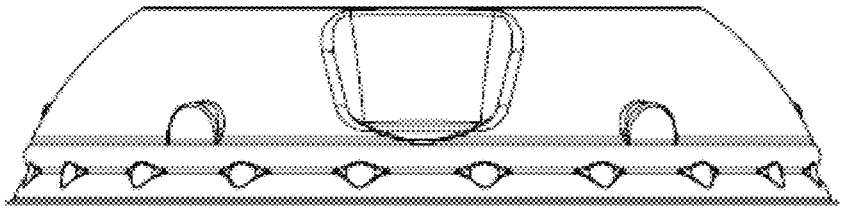
FIG. 8I is a top-side view of the food container lid of FIG. 8A.
Figure 8J:
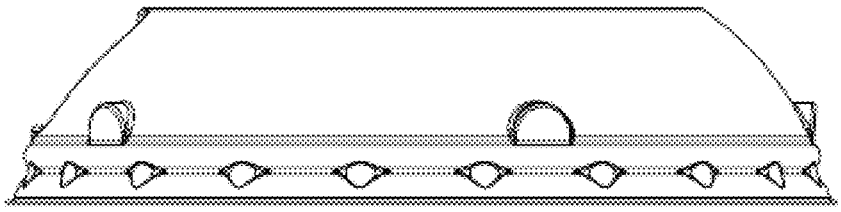
FIG. 8J is a right-side view of the food container lid of FIG. 8A.
Figure 8K:
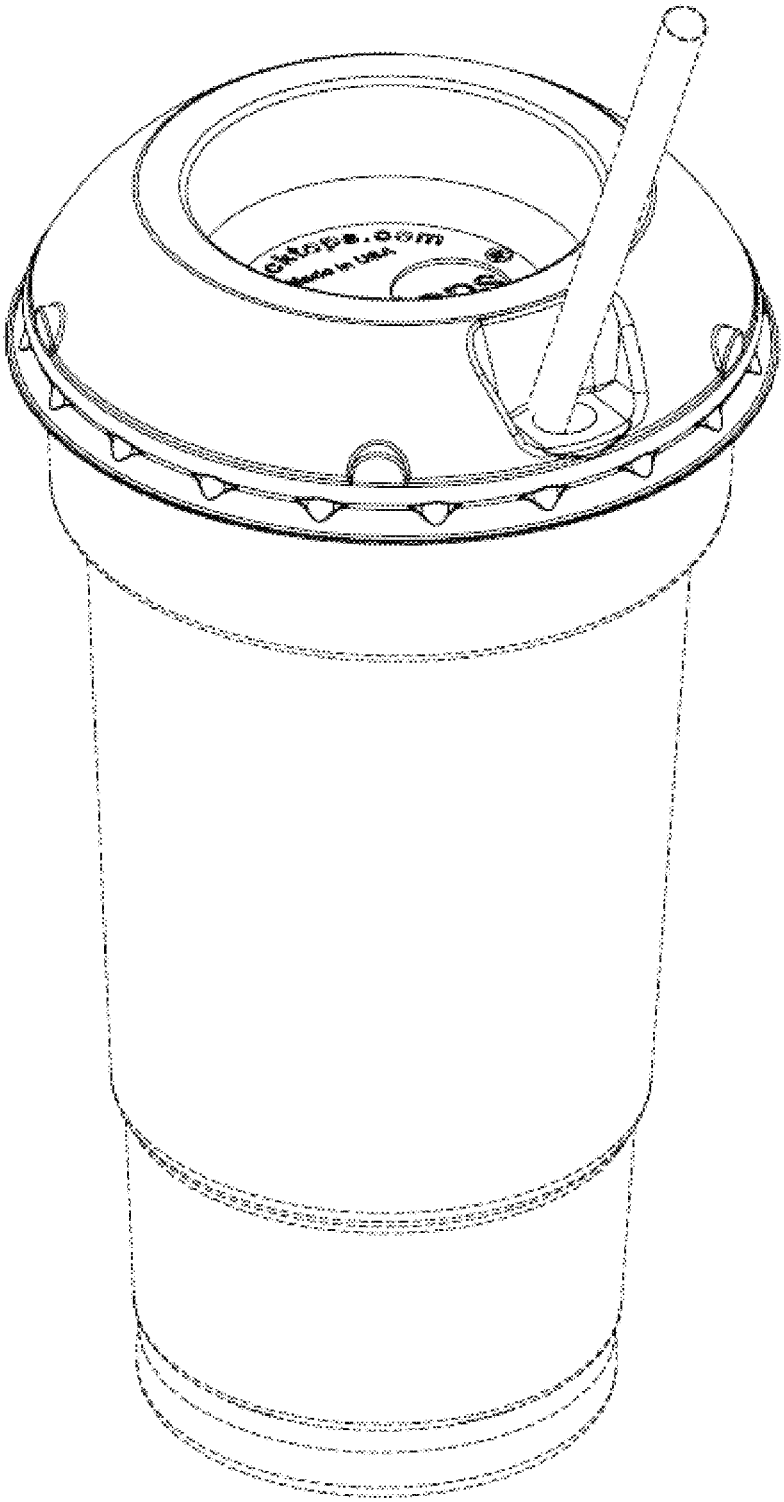
FIG. 8K shows the food container lid of FIG. 8A mounted to a beverage container.
Figure 9D:
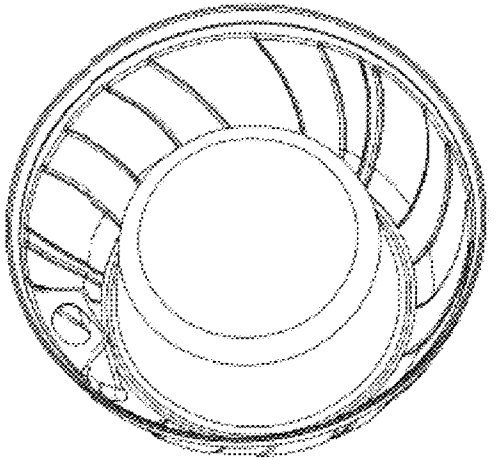
FIG. 9D is a back perspective view of the food container lid of FIG. 9A.
Figure 9E:
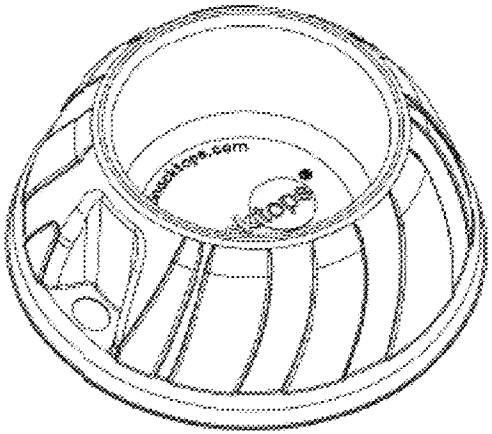
FIG. 9E is a side perspective view of the food container lid of FIG. 9A.
Figure 9B:
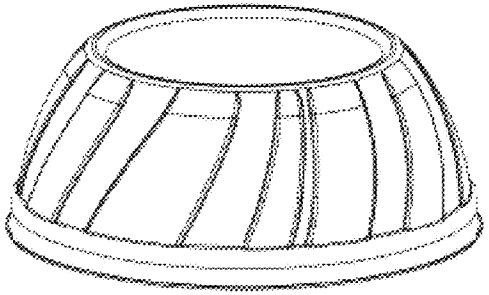
FIG. 9B is a side perspective view of the food container lid of FIG. 9A.
Figure 9A:
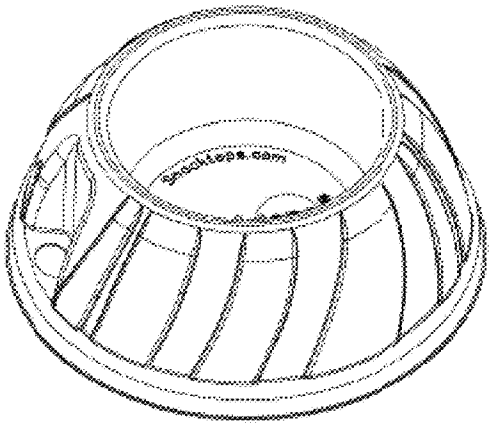
FIG. 9A is a front perspective view of an embodiment of the food container lid.
Figure 9C:
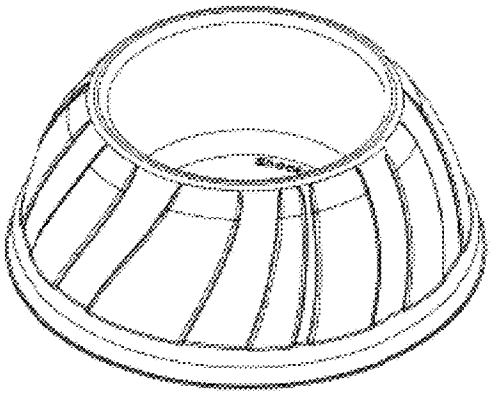
FIG. 9C is a side perspective view of the food container lid of FIG. 9A.
Figure 10D:
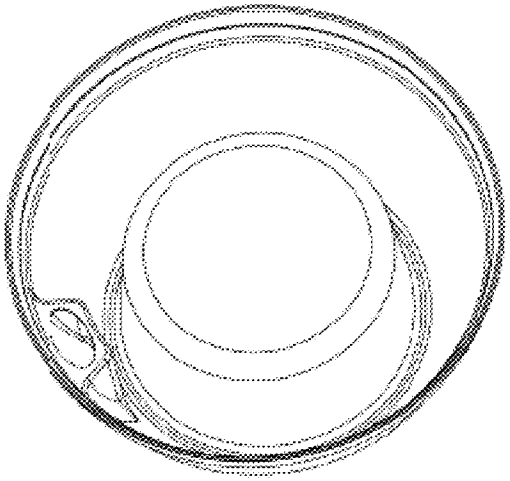
FIG. 10D is a back perspective view of the food container lid of FIG. 10A.
Figure 10E:
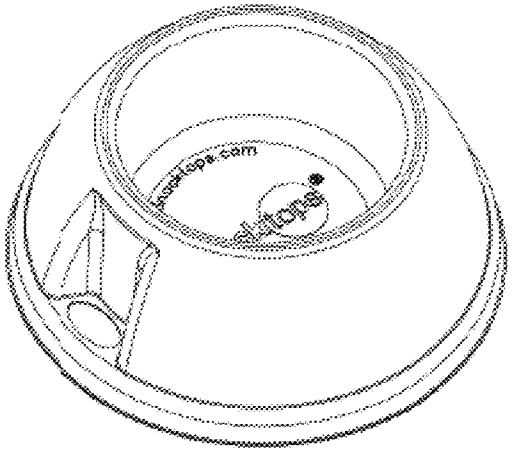
FIG. 10E is a side perspective view of the food container lid of FIG. 10A.
Figure 10B:
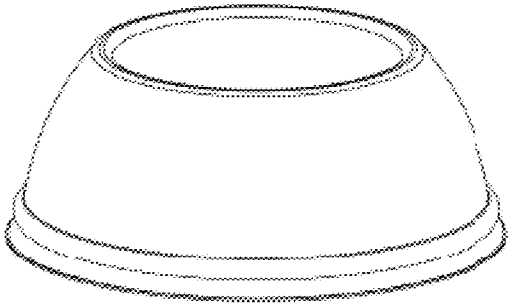
FIG. 10B is a side perspective view of the food container lid of FIG. 10A.
Figure 10A:
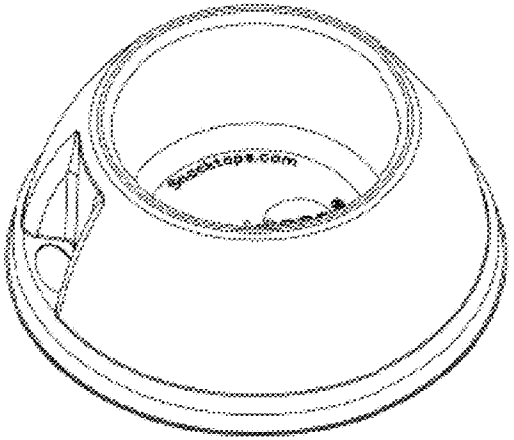
FIG. 10A is a front perspective view of an embodiment of the food container lid.
Figure 10C:
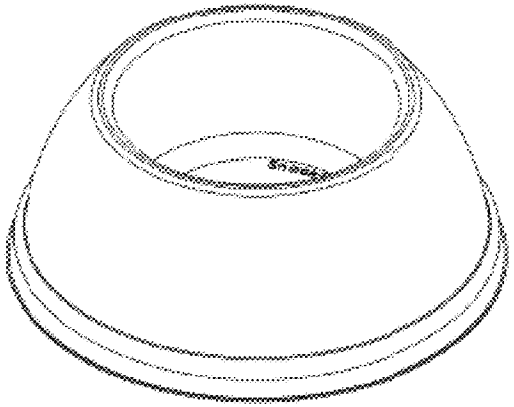
FIG. 10C is a side perspective view of the food container lid of FIG. 10A.

FIGS. 3J and 3K illustrate the position of drink/straw hole 65 relative to the mounting of the second food container/tray 80A. Theses figure demonstrate that a user can still access the liquid in the beverage container when the second food container/tray 80A is mounted. The drink/straw hole 65 is placed adjacent to the outer edge of the food container lid 10A, allowing the straw to enter with being obstructed by the second food container/tray 80A.

The teaching and disclosure herein may be used with a variety of food container lids, such as those shown in FIGS. 4A-10E. It should be noted that the annular surface may be concentric with the lid footprint (see e.g. FIG. 6A-6K, 8A-8K) or non-concentric (see e.g. FIGS. 4A-4K, 5A-5J, and 7A-7K).

The food container tray herein may be constructed using a variety of methods, including by non-limiting example thermoformed (thin gauge) and thin wall injection molding. The types of material would be apparent to one of skill in the art and may include by non-limiting example PP (polypropylene), PET (polyethylene terephthalate), CPET, RPET Polyethylene (HDPE/LDPE), styrene, HIPS, HMWPE, PP/PE blends, custom blends of thermoplastics (which may or may not include post-consumer or post-industrial content) and other proprietary blends of thermoplastics. Further the materials used may allow for elastic deflection such that the coupling structures disclosed above can deflect when mating to components together and then re-assume their original shape to assist in maintaining a secure fit between the components.

Although exemplary embodiments and applications of the invention have been described herein including as described above and shown in the included example Figures, there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that are allowed by the patent office based on this or any related patent application.

The invention claimed is:

1. A food container system comprising:

a food container lid comprising:

a beverage container coupling structure adapted to be removably attached to a beverage container, the beverage container coupling structure circumscribes a footprint of the lid;

a drink-hole surface within the lid footprint;

an annular surface above the beverage container coupling structure, within the lid footprint, and connected to the drink-hole surface, the annular surface comprising a food container coupling structure adapted to removably attach to a second food container;

a food compartment comprising a container inner wall extending from the annular surface, and a bottom connected to the container inner wall; and a drink hole for drinking a liquid in the beverage container, extending through the drink-hole surface.

2. The food container system of claim 1, the annular surface comprising a rim and an annular surface outer wall outer wall extending from the rim to a position lower than the rim, wherein the annular surface outer wall comprises the food container coupling structure.

3. The food container system of claim 1, further comprising a cover that covers the food compartment.

4. The food container system of claim 1, further comprising a cup adapted to nest in the food compartment.

5. The food container system of claim 4, wherein the cup further comprises a cover.

6. The food container system of claim 4, wherein:

the cup comprises a cup coupling structure; and the container inner wall comprises a complementary cup coupling structure adapted to detachably mate with the cup coupling structure, thereby securing the cup in the food container.

7. The food container system of claim 1 wherein the annular surface is non-concentric with the lid footprint.

8. The food container system of claim 1, further comprising the second food container, the second food container comprises a bottom, the bottom comprising a complementary food container coupling structure adapted to detachably mate with the food container coupling structure, thereby securing the cup to the second food container to the food container lid.

9. The food container system of claim 8, wherein the complementary food container coupling structure comprises an inner wall that further comprises an inner wall coupling structure.

10. The food container system of claim 9, wherein the inner wall coupling structure mates with the food container coupling structure.

11. The food container system of claim 8, wherein the complementary food container coupling structure comprises an outer wall that further comprises an outer wall coupling structure.

12. A food container system comprising:

a food container lid comprising:

a beverage container coupling structure adapted to be removably attached to a beverage container, the beverage container coupling structure circumscribes a footprint of the lid;

a drink-hole surface within the lid footprint;

an annular surface above the beverage container coupling structure, within the lid footprint, and connected to the drink-hole surface;

a food compartment comprising a container inner wall extending from the annular surface, and a bottom connected to the container inner wall, the inner wall comprising a food container coupling structure adapted to removably attach to a second food container; and a drink hole for drinking a liquid in the beverage container, extending through the drink-hole surface.

13. The food container system of claim 12, further comprising a cover that covers the food compartment.

14. The food container system of claim 12, further comprising a cup adapted to nest in the food compartment.

15. The food container system of claim 14, wherein the cup further comprises a cover.

16. The food container system of claim 14, wherein:

the cup comprises a cup coupling structure; and the container inner wall comprises a complementary cup coupling structure adapted to detachably mate with the cup coupling structure, thereby securing the cup in the food container.

17. The food container system of claim 12 wherein the annular surface is non-concentric with the lid footprint.

18. The food container system of claim 12, further comprising the second food container, the second food container comprises a bottom, the bottom comprising a complementary food container coupling structure adapted to detachably mate with the food container coupling structure, thereby securing the cup to the second food container to the food container lid.

19. The food container system of claim 18, wherein the complementary food container coupling structure comprises an inner wall that further comprises an inner wall coupling structure.

20. The food container system of claim 18, wherein the complementary food container coupling structure comprises an outer wall that further comprises an outer wall coupling structure.

21. The food container system of claim 20, wherein the outer wall coupling structure mates with the food container coupling structure.

* * * * *